US009529310B2

(12) United States Patent
Nakayama

(10) Patent No.: US 9,529,310 B2
(45) Date of Patent: Dec. 27, 2016

(54) IMAGE HEATING APPARATUS

(71) Applicant: CANON KABUSHIKI KAISHA, Tokyo (JP)

(72) Inventor: Toshinori Nakayama, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/794,869

(22) Filed: Jul. 9, 2015

(65) Prior Publication Data

US 2016/0011551 A1 Jan. 14, 2016

(30) Foreign Application Priority Data

Jul. 9, 2014 (JP) ..... 2014-141765

(51) Int. Cl.
*G03G 15/20* (2006.01)

(52) U.S. Cl.
CPC ..... *G03G 15/2053* (2013.01)

(58) Field of Classification Search
CPC combination set(s) only.
See application file for complete search history.

(56) References Cited

U.S. PATENT DOCUMENTS

| | | | |
|---|---|---|---|
| 7,193,181 | B2 | 3/2007 | Makihira et al. |
| 7,260,351 | B2 | 8/2007 | Nakayama |
| 7,263,303 | B2 | 8/2007 | Nakayama |
| 7,343,130 | B2 | 3/2008 | Nakayama |
| 7,430,392 | B2 | 9/2008 | Ito et al. |
| 7,460,821 | B2 | 12/2008 | Ai et al. |
| 7,505,724 | B2 | 3/2009 | Nakayama |
| 7,590,366 | B2 | 9/2009 | Nakayama |

(Continued)

FOREIGN PATENT DOCUMENTS

| | | | |
|---|---|---|---|
| JP | H05-27631 | A | 2/1993 |
| JP | 2006-039514 | A | 2/2006 |

(Continued)

OTHER PUBLICATIONS

U.S. Appl. No. 14/718,557, dated May 21, 2015.

(Continued)

*Primary Examiner* — Walter L Lindsay, Jr.
*Assistant Examiner* — Jas Sanghera
(74) *Attorney, Agent, or Firm* — Fitzpatrick, Cella, Harper & Scinto

(57) ABSTRACT

An image heating apparatus includes: an electric energy supplying portion, an endless belt and a heater. The heater includes a substrate, electrode portions including first electrode portions and second electrode portions, a plurality of heat generating portions, and a connecting circuit. The electric energy supplying portion supplies electric energy to the first heat generating portions when a sheet having a predetermined width is heated, and supplies electric energy to the first heat generating portions and the second heat generating portions when a sheet having a width broader than the predetermined width is heated. The connecting circuit includes a single interrupting element configured to interrupt electric energy supply from the electric energy supplying portion to the heater. The interrupting element is provided so as to establish the positional relationship that the interrupting element opposes the first heat generating portions with respect to a longitudinal direction of the substrate.

15 Claims, 13 Drawing Sheets

(56) References Cited

U.S. PATENT DOCUMENTS

| | | | | |
|---|---|---|---|---|
| 7,729,628 | B2 | 6/2010 | Nakayama | |
| 7,907,861 | B2 | 3/2011 | Nakayama | |
| 8,145,086 | B2 | 3/2012 | Chiyoda et al. | |
| 8,306,446 | B2 | 11/2012 | Ito et al. | |
| 8,391,761 | B2 | 3/2013 | Mitsuoka et al. | |
| 8,559,837 | B2 | 10/2013 | Nakayama | |
| 8,712,271 | B2 | 4/2014 | Nakayama et al. | |
| 8,750,739 | B2 | 6/2014 | Tamaki et al. | |
| 2006/0000819 | A1 | 1/2006 | Makihira et al. | |
| 2009/0232569 | A1* | 9/2009 | Ishino ..... | G03G 15/2053 399/333 |
| 2009/0245900 | A1* | 10/2009 | Kagawa ..... | G03G 15/2042 399/329 |
| 2010/0303525 | A1 | 12/2010 | Mitsuoka et al. | |
| 2013/0299480 | A1 | 11/2013 | Kakubari et al. | |
| 2013/0322897 | A1 | 12/2013 | Yago et al. | |

FOREIGN PATENT DOCUMENTS

| | | | |
|---|---|---|---|
| JP | 2010-276729 | A | 12/2010 |
| JP | 2012-037613 | A | 2/2012 |

OTHER PUBLICATIONS

U.S. Appl. No. 14/718,672, dated May 21, 2015.
U.S. Appl. No. 14/719,474, dated May 22, 2015.
U.S. Appl. No. 14/719,497, dated May 22, 2015.
U.S. Appl. No. 14/799,056, dated Jul. 14, 2015.
U.S. Appl. No. 14/844,249, dated Sep. 3, 2015.
U.S. Appl. No, 14/857,086, dated Sep. 17, 2015.

* cited by examiner

| | SW | | HEAT GENERATING REGION | | |
|---|---|---|---|---|---|
| | SW653 | SW663 | b1 | A | b2 |
| STATE 1 | ○ | × | × | ○ | × |
| STATE 2 | ○ | ○ | ○ | ○ | ○ |
| STATE 3 | × | ○ | × | × | × |
| STATE 4 | × | × | × | × | × |

Fig. 9

| | SW | | | | HEAT GENERATING REGION | | | | |
|---|---|---|---|---|---|---|---|---|---|
| | 1033a | 1033b | 1033c | 1033d | 1025a | 1025b | 1025c | 1025d | 1025e |
| STATE 1 | ○ | ○ | ○ | ○ | short circuit | | | | |
| STATE 2 | ○ | ○ | ○ | × | short circuit | | | | |
| STATE 3 | ○ | ○ | × | ○ | short circuit | | | | |
| STATE 4 | ○ | ○ | × | × | ○ | ○ | ○ | ○ | ○ |
| STATE 5 | ○ | × | ○ | ○ | short circuit | | | | |
| STATE 6 | ○ | × | ○ | × | short circuit | | | | |
| STATE 7 | ○ | × | × | ○ | short circuit | | | | |
| STATE 8 | ○ | × | × | × | × | × | × | × | ○ |
| STATE 9 | × | ○ | ○ | ○ | short circuit | | | | |
| STATE 10 | × | ○ | ○ | × | short circuit | | | | |
| STATE 11 | × | ○ | × | ○ | short circuit | | | | |
| STATE 12 | × | ○ | × | × | ○ | ○ | × | × | × |
| STATE 13 | × | × | ○ | ○ | × | ○ | ○ | ○ | × |
| STATE 14 | × | × | ○ | × | × | × | × | ○ | ○ |
| STATE 15 | × | × | × | ○ | ○ | × | × | × | × |
| STATE 16 | × | × | × | × | × | × | × | × | × |

Fig. 10

IMAGE HEATING APPARATUS

FIELD OF THE INVENTION AND RELATED ART

The present invention relates to an image heating apparatus for heating an image on a sheet. The image heating apparatus is usable with an image forming apparatus such as a copying machine, a printer, a facsimile machine, a multi-function machine having a plurality of functions thereof or the like.

An image forming apparatus is known in which a toner image is formed on the sheet and is fixed on the sheet by heat and pressure in a fixing device (image heating apparatus). As for such a fixing device, a type of fixing device is proposed (Japanese Laid-open Patent Application 2012-37613) in which a heat generating element (heater) is contacted to an inner surface of a thin flexible belt to apply heat to the belt. Such a fixing device is advantageous in that the structure has a low thermal capacity, and therefore, the temperature rise to make the fixing operation allowable is quick.

Japanese Laid-open Patent Application 2012-37613 discloses a structure of a fixing device in which a heat generating region width of the heat generating element (heater) is controlled in accordance with a width size of the sheet. Specifically, this fixing device causes only a central heat generating resistor layer (heat generating block) to generate heat when a small-sized sheet is subjected to a fixing process and causes the central heat generating block and end portion heat generating blocks to generate heat when a large-sized sheet is subjected to the fixing process. This fixing device suppresses heat generation of the heater by the above-described constitution in widthwise end portion regions where the small-sized sheet does not pass when the sheet is subjected to the fixing process.

The fixing device for supplying electric energy (electric power) to the heater on the basis of an instruction from a controller is required to be safely stopped even if the controller is out of control, and thus the heater abnormally generates heat. For that reason, it is desirable that an interrupting element (safety element) for interrupting (breaking) the electric energy (electric power) supply to the heater by detecting abnormal heat generation of the heater is provided.

However, as in the heater of Japanese Laid-Open Patent Application 2012-37613, in the heater capable of changing a heat generation width depending on the width size of the sheet, the electric energy is independently supplied to the central heat generating block and each of the end portion heat generating blocks. For that reason, the central heat generating block and each of the end portion heat generating blocks are independently capable of abnormally generating heat. Accordingly, the fixing device using such a heater is required to take a countermeasure against each of the heat generating blocks capable of independently generating heat. However, in the case where the interrupting element is intended to be provided for each of the heat generating blocks capable of independently generating heat, the number of required interrupting elements is large, so that there is a liability that the interrupting elements lead to an increase in cost.

For this reason, in the fixing device using the heater including a plurality of heat generating blocks, it is required that the increase in cost is suppressed by reducing the number of the interrupting elements used.

SUMMARY OF THE INVENTION

Accordingly, it is an object of the present invention to provide a heater with a suppressed increase in cost.

According to an aspect of the present invention, there is provided an image heating apparatus comprising: an electric energy supplying portion provided with a first terminal and a second terminal; an endless belt configured to heat an image on a sheet; and a heater configured to heat the belt in contact with the belt. The heater comprises, a substrate extending along a longitudinal direction of said belt, a plurality of electrode portions including first electrode portions electrically connectable to the first terminal and second electrode portions electrically connectable to the second terminal, the first electrode portions and the second electrode portions being arranged alternately with gaps in the longitudinal direction of the substrate, a plurality of heat generating portions provided between adjacent ones of the electrode portions so as to electrically connect between adjacent electrode portions, the heat generating portions being capable of generating heat by electric power supply between adjacent electrode portions and including first heat generating portions and second heat generating portions adjacent to the first heat generating portions with respect to a longitudinal direction of the substrate, and a connecting circuit configured to electrically connect the heater to the electric energy supplying portion. The connecting circuit permitting electrical connection of the electric energy supplying portion and the second heat generating portions by electrical connection of the electric energy supplying portion and the first heat generating portion. The electric energy supplying portion supplies electric energy to the first heat generating portions when a sheet having a predetermined width size is heated, and supplies electric energy to the first heat generating portions and the second heat generating portions when a sheet having a width size broader than the predetermined width size is heated. The connecting circuit includes a single interrupting element configured to interrupt electric energy supply from the electric energy supplying portion to the heater when a temperature of the first heat generating portions reaches a predetermined temperature higher than a target temperature where the sheet is heated. The interrupting element is provided so as to establish a positional relationship that the interrupting element opposes the first heat generating portions with respect to the longitudinal direction of the substrate.

According to another aspect of the present invention, there is provided an image heating apparatus comprising: an electric energy supplying portion provided with a first terminal and a second terminal; an endless belt configured to heat an image on a sheet; and a heater configured to heat the belt in contact with the belt. The heater comprises, a substrate extending along a longitudinal direction of the belt, a plurality of electrode portions including first electrode portions electrically connectable to the first terminal and second electrode portions electrically connectable to the second terminal, the first electrode portions and the second electrode portions being arranged alternately with gaps in the longitudinal direction of the substrate, a plurality of heat generating portions provided between adjacent ones of the electrode portions so as to electrically connect between adjacent electrode portions, the heat generating portions being capable of generating heat by electric power supply between adjacent electrode portions and including first heat generating portions and second heat generating portions adjacent to the first heat generating portions with respect to the longitudinal direction of the substrate, a connecting circuit configured to electrically connect the electric energy supplying portion to the plurality of heat generating portions via second plurality of electrode portions, the connecting circuit permitting electrical connection of the electric energy supplying portion and the second heat generating portions by electrical connection of the electric energy supplying portion and the first heat generating portions, and a detecting portion configured to detect a temperature of the first heat generating portions. The electric energy supplying portion supplies electric energy to the first heat generating portions when a sheet having a predetermined width size is heated, and supplies electric energy to the first heat generating portions and the second heat generating portions when a sheet having a width size broader than the predetermined width size is heated. The the connecting circuit includes an interrupting element configured to interrupt electric energy supply from the electric energy supplying portion to the heater on the basis of a signal inputted from the detecting portion without via the electric energy supplying portion when the temperature of the first heat generating portions reaches a predetermined temperature higher than a target temperature where the sheet is heated.

Further features of the present invention will become apparent from the following description of exemplary embodiments with reference to the attached drawings.

BRIEF DESCRIPTION OF THE DRAWINGS

FIG. 9 is a list for illustrating states of a fixing device in Embodiment 1.

FIG. 10 is a list for illustrating states of a fixing device in a Conventional Example.

DESCRIPTION OF THE EMBODIMENTS

Embodiments of the present invention will be described in conjunction with the accompanying drawings. In this embodiment, the image forming apparatus is a laser beam printer using an electrophotographic process as an example. The laser beam printer will be simply called printer.

Embodiment 1

Image Forming Apparatus

Figure 1:
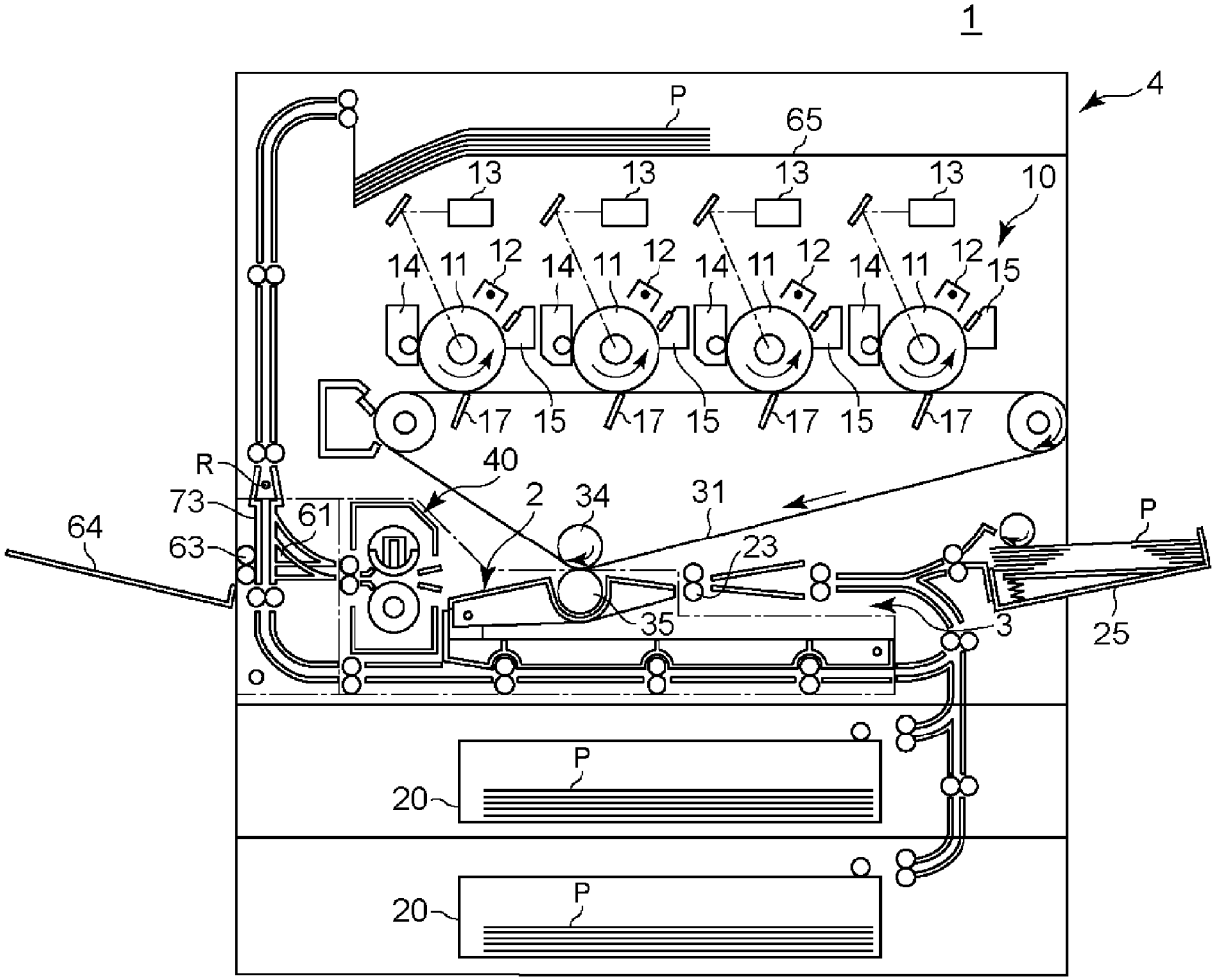
FIG. 1 is a sectional view of an image forming apparatus according to Embodiment 1.

FIG. 1 is a sectional view of the printer 1 which is the image forming apparatus of this embodiment. The printer 1 comprises an image forming station 10 and a fixing device 40, in which a toner image formed on the photosensitive drum 11 is transferred onto a sheet P, and is fixed on the sheet P, by which an image is formed on the sheet P. Referring to FIG. 1, the structures of the apparatus will be described in detail.

As shown in FIG. 1, the printer 1 includes image forming stations 10 for forming respective color toner images Y (yellow), M (magenta), C (cyan) and Bk (black). The image forming stations 10 includes respective photosensitive drums 11 corresponding to Y, M, C, Bk colors arranged in the order named from the left side. Around each drum 11, similar elements are provided as follows: a charger 12; an exposure device 13; a developing device 14; a primary transfer blade 17; and a cleaner 15. The structure for the Bk toner image formation will be described as a representative, and the descriptions for the other colors are omitted for simplicity by assigning the like reference numerals. So, the elements will be simply called photosensitive drum 11, charger 12, exposure device 13, developing device 14, primary transfer blade 17 and cleaner 15 with these reference numerals.

The photosensitive drum 11 as an electrophotographic photosensitive member is rotated by a driving source (unshown) in the direction indicated by an arrow (counterclockwise direction in FIG. 1). Around the photosensitive drum 11, the charger 12, the exposure device 13, the developing device 14, the primary transfer blade 17 and the cleaner 15 are provided in the order named.

A surface of the photosensitive drum 11 is electrically charged by the charger 12. Thereafter, the surface of the photosensitive drum 11 exposed to a laser beam in accordance with image information by the exposure device 13, so that an electrostatic latent image is formed. The electrostatic latent image is developed into a Bk toner image by the developing device 14. At this time, similar processes are carried out for the other colors. The toner image is transferred from the photosensitive drum 11 onto an intermediary transfer belt 31 by the primary transfer blade 17 sequentially (primary-transfer). The toner remaining on the photosensitive drum 11 after the primary-image transfer is removed by the cleaner 15. By this, the surface of the photosensitive drum 11 is cleaned so as to be prepared for the next image formation.

On the other hand, the sheet P contained in a feeding cassette 20 or placed on a multi-feeding tray 25 is picked up by a feeding mechanism (unshown) and fed to a pair of registration rollers 23. The sheet P is a member on which the image is formed. Specific examples of the sheet P are plain paper, a thick sheet, a resin material sheet, an overhead projector film or the like. The pair of registration rollers 23 once stops the sheet P for correcting oblique feeding. The registration rollers 23 then feed the sheet P into between the intermediary transfer belt 31 and the secondary transfer roller 35 in timed relation with the toner image on the intermediary transfer belt 31. The roller 35 functions to transfer the color toner images from the belt 31 onto the sheet P. Thereafter, the sheet P is fed into the fixing device (image heating apparatus) 40. The fixing device 40 applies heat and pressure to the toner image T on the sheet P to fix the toner image on the sheet P.

[Fixing Device]

Figure 2:
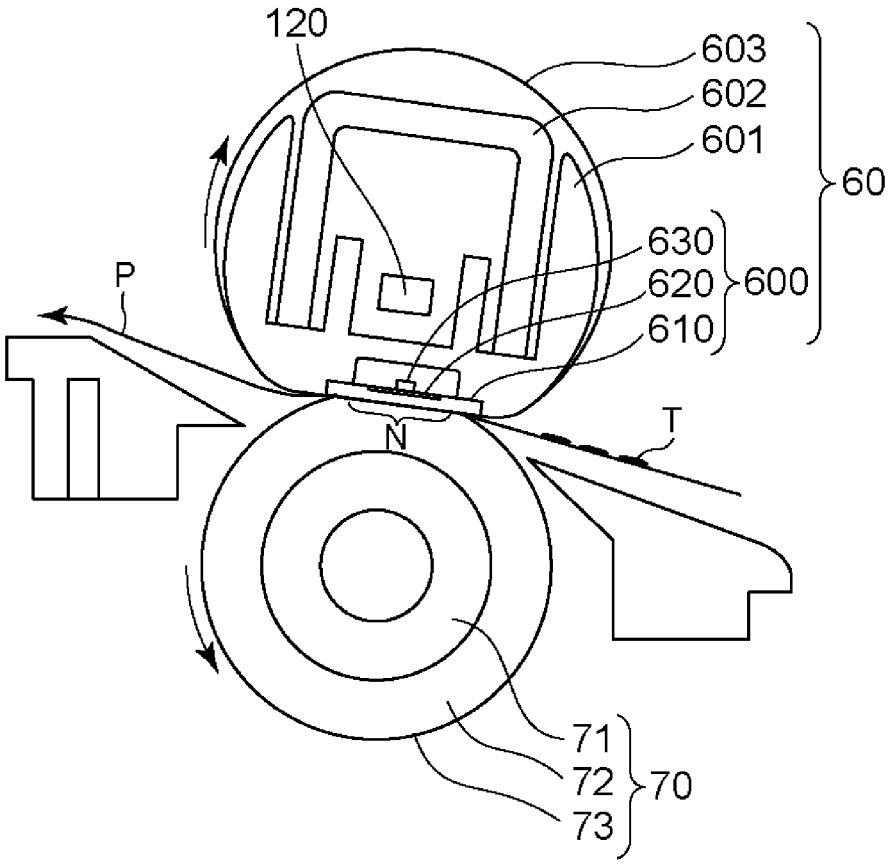
FIG. 2 is a sectional view of an image heating apparatus according to Embodiment 1.
Figure 3:
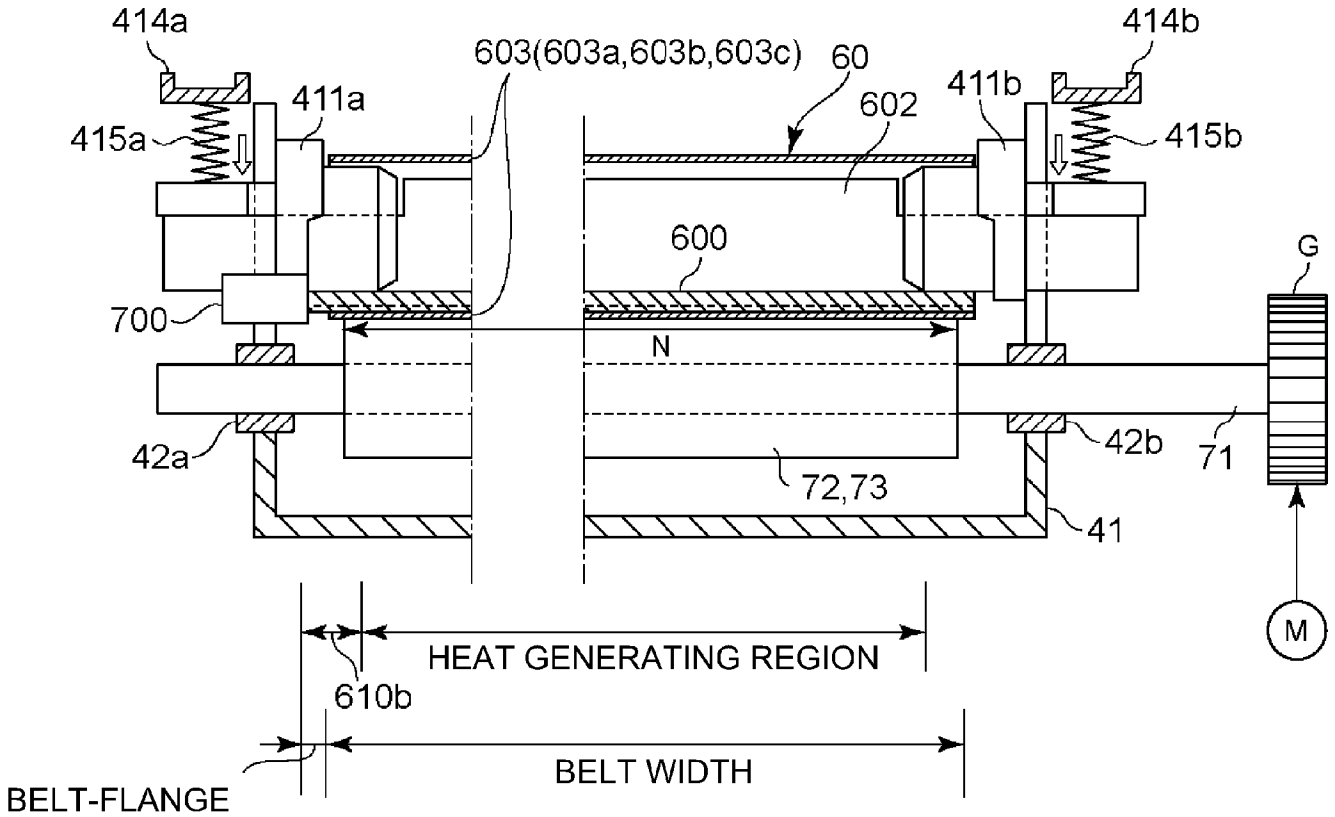
FIG. 3 is a front view of the image heating apparatus according to Embodiment 1.
Figure 5:
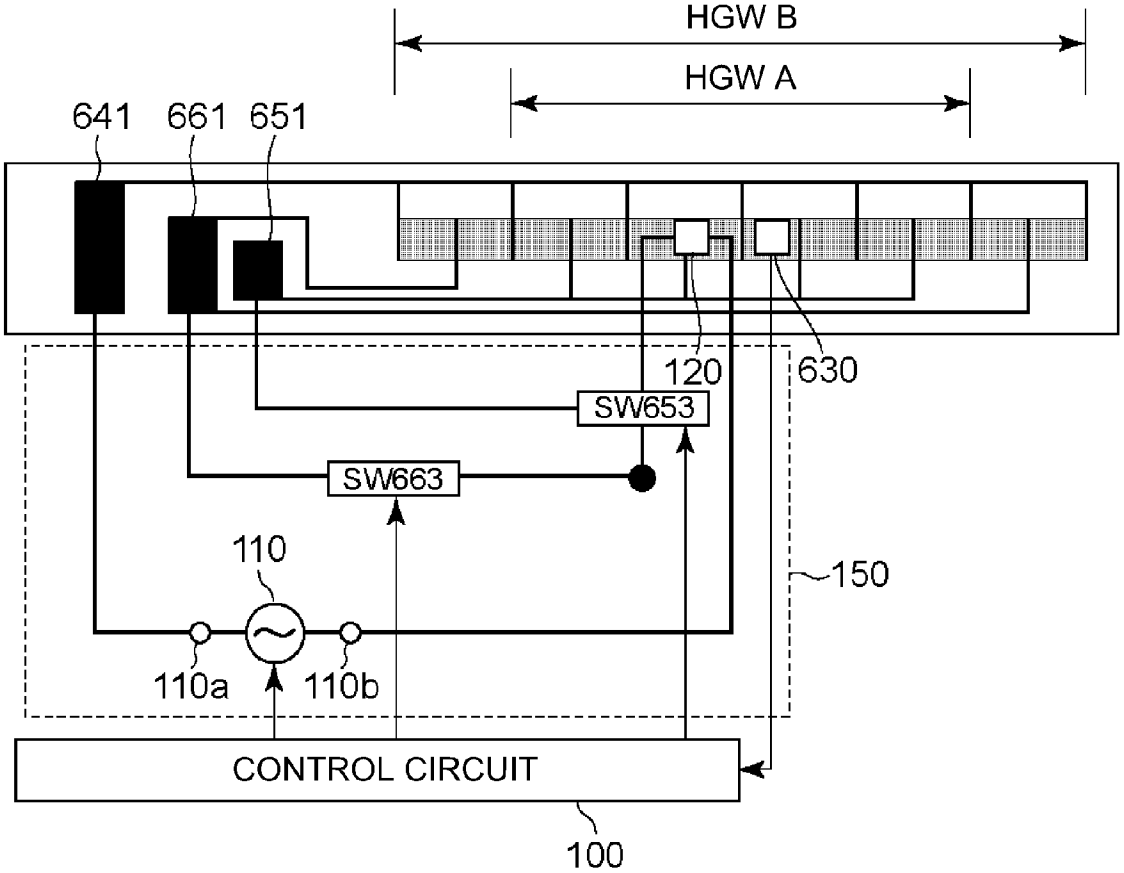
FIG. 5 illustrates the structural relationship of the image heating apparatus according to Embodiment 1.

The fixing device 40 which is the image heating apparatus used in the printer 1 will be described. FIG. 2 is a sectional view of the fixing device 40. FIG. 3 is a front view of the fixing device 40. FIG. 5 illustrates a structural relationship of the fixing device 40.

The fixing device 40 is an image heating apparatus for heating the image on the sheet by a heater unit 60 (unit 60). The unit 60 includes a flexible thin fixing belt 603 and the heater 600 contacted to the inner surface of the belt 603 to heat the belt 603 (a low thermal capacity structure). Therefore, the belt 603 can be efficiently heated, so that a quick temperature rise at the start of the fixing operation is accomplished. As shown in FIG. 2, the belt 603 is nipped between the heater 600 and the pressing roller 70 (roller 70), by which a nip N is formed. The belt 603 rotates in the direction indicated by the arrow (clockwise in FIG. 2), and the roller 70 is rotated in the direction indicated by the arrow (counterclockwise in FIG. 2) to nip and feed the sheet P supplied to the nip N. At this time, the heat from the heater 600 is supplied to the sheet P through the belt 603, and therefore, the toner image T on the sheet P is heated and pressed by the nip N, so that the toner image it fixed on the sheet P by the heat and pressure. The sheet P having passed through the fixing nip N is separated from the belt 603 and is discharged. In this embodiment, the fixing process is carried out as described above. The structure of the fixing device 40 will be described in detail.

Unit 60 is a unit for heating and pressing an image on the sheet P. A longitudinal direction of the unit 60 is parallel with the longitudinal direction of the roller 70. The unit 60 comprises a heater 600, a heater holder 601, a support stay 602 and a belt 603.

The heater 600 is a heating member for heating the belt 603, slidably contacting with the inner surface of the belt 603. The heater 600 is pressed to the inside surface of the belt 603 toward the roller 70 so as to provide a desired nip width of the nip N. The dimensions of the heater 600 in this embodiment are 5-20 mm in the width (the dimension as measured in the left-right direction in FIG. 2), 350-400 mm in the length (the dimension measured in the front-rear direction in FIG. 2), and 0.5-2 mm in the thickness. The heater 600 comprises a substrate 610 elongated in a direction perpendicular to the feeding direction of the sheet P (widthwise direction of the sheet P), and a heat generating resistor 620 (heat generating element 620).

The heater 600 is fixed on the lower surface of the heater holder 601 along the longitudinal direction of the heater holder 601. In this embodiment, the heat generating element 620 is provided on the back side of the substrate 610 which is not in slidable contact with the belt 603, but the heat generating element 620 may be provided on the front surface of the substrate 610 which is in slidable contact with the belt 603. However, the heat generating element 620 of the heater 600 is preferably provided on the back side of the substrate 610, by which uniform heating effect to the substrate 610 is accomplished, from the standpoint of preventing non-uniform heat application, to the belt 603, which may be caused by a non-heat-generating portion of the heat generating element 620. The details of the heater 600 will be described hereinafter.

The belt 603 is a cylindrical (endless) belt (film) for heating the image on the sheet in the nip N. The belt 603 comprises a base material 603*a*, an elastic layer 603*b* thereon, and a parting layer 603*c* on the elastic layer 603*b*, for example. The base material 603*a* may be made of metal material such as stainless steel or nickel, or a heat resistive resin material such as polyimide. The elastic layer 603*b* may be made of an elastic and heat resistive material such as a silicone rubber or a fluorine-containing rubber. The parting layer 603*c* may be made of fluorinated resin material or silicone resin material.

The belt 603 of this embodiment has dimensions of approx. 30 mm in the outer diameter, approx. 330 mm in the length (the dimension measured in the front-rear direction in FIG. 2), approx. 30 μm in the thickness, and the material of the base material 603*a* is nickel. The silicone rubber elastic layer 603*b* having a thickness of approx. 400 μm is formed on the base material 603*a*, and a fluorine resin tube (parting layer 603*c*) having a thickness of approx. 20 μm coats the elastic layer 603*b*.

The belt contacting surface of the substrate 610 may be provided with a polyimide layer having a thickness of approx. 10 μm as a sliding layer 603*d*. When the polyimide layer is provided, the rubbing resistance between the fixing belt 603 and the heater 600 is low, and therefore, the wearing of the inner surface of the belt 603 can be suppressed. In order to further enhance the slidability, a lubricant such as grease may be applied to the inner surface of the belt.

The holder 601 is a holding member for holding the heater 600 in the state of urging the heater 600 toward the inner surface of the belt 603. The holder 601 has a semi-arcuate cross-section (the surface of FIG. 2) and functions to regulate a rotation orbit of the belt 603. The holder 601 may be made of heat resistive resin material or the like. In this embodiment, it is Zenite 7755 (tradename) available from Dupont.

The stay 602 supports the heater 600 by way of the holder 601. The stay 602 is preferably made of a material which is not easily deformed even when a high pressure is applied thereto, and in this embodiment, it is made of SUS304 (stainless steel).

As shown in FIG. 3, the stay 602 is supported by left and right flanges 411*a* and 411*b* at the opposite end portions with respect to the longitudinal direction. The flanges 411*a* and 411*b* may be simply called flange 411. The flange 411 regulates the movement of the belt 603 in the longitudinal direction and the circumferential direction configuration of the belt 603. The flange 411 is made of heat resistive resin material or the like. In this embodiment, it is PPS (polyphenylenesulfide resin material).

Between the flange 411*a* and a pressing arm 414*a*, an urging spring 415*a* is compressed. Also, between a flange 411*b* and a pressing arm 414*b*, an urging spring 415*b* is compressed. The urging springs 415*a* and 415*b* may be simply called urging spring 415. With such a structure, an elastic force of the urging spring 415 is applied to the heater 600 through the flange 411 and the stay 602. The belt 603 is pressed against the upper surface of the roller 70 at a predetermined urging force to form the nip N having a predetermined nip width. In this embodiment, the pressure is approx. 156.8 N (approx. 16 kgf) at one end portion side and approx. 313.6 N (approx. 32 kgf) in total.

As shown in FIG. 3, a connector 700 is provided as an electric energy supplying member electrically connected with the heater 600 to supply the electric power to the heater 600. The connector 700 is detachably provided at one longitudinal end portion of the heater 600. The connector 700 is easily detachably mounted to the heater 600, and therefore, assembling of the fixing device 40 and the exchange of the heater 600 or belt 603 upon damage of the heater 600 is easy, thus providing a good maintenance property. Details of the connector 700 will be described hereinafter.

As shown in FIG. 2, the roller 70 is a nip forming member which contacts an outer surface of the belt 603 to cooperate with the belt 603 to form the nip N. The roller 70 has a multi-layer structure on the metal core 71 composed of metal material, the multi-layer structure including an elastic layer 72 on the metal core 71 and a parting layer 73 on the elastic layer 72. Examples of the materials of the metal core 71 include SUS (stainless steel), SUM (sulfur and sulfur-containing free-machining steel), Al (aluminum) or the like.

Examples of the materials of the elastic layer 72 include an elastic solid rubber layer, an elastic foam rubber layer, an elastic porous rubber layer or the like. Examples of the materials of the parting layer 73 include fluorinated resin material.

The roller 70 of this embodiment includes a metal core 71 of steel, an elastic layer 72 of silicone rubber foam on the metal core 71, and a parting layer 73 of fluorine resin tube on the elastic layer 72. Dimensions of the portion of the roller 70 having the elastic layer 72 and the parting layer 73 are approx. 25 mm in outer diameter, and approx. 330 mm in length.

A thermistor 630 is a temperature sensor provided on a back side of the heater 600 (opposite side from the sliding surface side. The thermistor 630 is bonded to the heater 600 in the state that it is insulated from the heat generating element 620. The thermistor 630 has a function of detecting a temperature of the heater 600. As shown in FIG. 5, the thermistor 630 is connected with a control circuit 100 through an A/D converter (unshown) and feeds an output corresponding to the detected temperature to the control circuit 100.

The control circuit 100 is a controlling device including a CPU operating for various controls, and a non-volatilization medium such as a ROM storing various programs. The programs are stored in the ROM, and the CPU reads and execute them to effect the various controls. The control circuit 100 may be an integrated circuit such as ASIC if it is capable of performing the similar operation.

As shown in FIG. 5, the control circuit 100 is electrically connected with the voltage source 110 so as to control electric power supply from the voltage source 110. The control circuit 100 is electrically connected with the thermistor 630 to receive the output of the thermistor 630.

The control circuit 100 uses the temperature information acquired from the thermistor 630 for the electric power supply control for the voltage source 110. More particularly, the control circuit 100 controls the electric power to the heater 600 through the voltage source 110 on the basis of the output of the thermistor 630. In this embodiment, the control circuit 100 carries out a wave number control of the output of the voltage source 110 to adjust an amount of heat generation of the heater 600. By such a control, the heater 600 is maintained at a target temperature (approx. 200 degree C., for example).

A temperature safety element 120 is an interrupting element for interrupting (breaking) the electric energy (electric power) supply to the heater 600 when the heater 600 abnormally generates heat. As the element 120, a circuit member such as a temperature fuse or a thermoswitch. The element 120 is disposed to establish a positional relationship in which the element 120 opposes the heater 600 in order to permit conduction of the heat of the heater 600. The element 120 in this embodiment is provided between the holder 601 and the stay 602. The position of the element 120 is not limited thereto if the abnormal heat generation of the heater 600 is detectable. For example, the element 120 may also be provided between the holder 601 and the heater 600. Further, the heater 600 is disposed at a position where a temperature detecting surface for detecting the temperature is spaced from an upper surface of the holder 601 by 1-2 mm. By such a constitution, the fixing device 40 suppresses an erroneous actuation (misoperation) of the element 120 caused by a quick temperature rise of the heater 600. Further, by disposing the element 120 in an environment in which the degree of a temperature change is small, deterioration of the element 120 is suppressed. The position of the element 120 is not limited to the above-described positions if the element 120 is disposed so as to be capable of detecting the temperature of the heater 600. For example, the element 120 may also be provided so as to contact the upper substrate of the holder 601 and the heater 600. However, from the viewpoint that the above-described erroneous actuation is suppressed, the constitution in this embodiment is preferred. Details of the element 120 will be described later.

As shown in FIG. 3, the metal core 71 of the roller 70 is rotatably held by bearings 41*a* and 41*b* provided in a rear side and a front side of the side plate 41, respectively. One axial end of the core metal 71 is provided with a gear G to transmit the driving force from a motor M to the core metal 71 of the roller 70. As shown in FIG. 2, the roller 70 receiving the driving force from the motor M rotates in the direction indicated by the arrow (clockwise direction). In the nip N, the driving force is transmitted to the belt 603 by the way of the roller 70, so that the belt 603 is rotated in the direction indicated by the arrow (counterclockwise direction).

The motor M is a driving means for driving the roller 70 through the gear G. As shown in FIG. 5, the control circuit 100 is electrically connected with the motor M to control the electric power supply to the motor M. When the electric energy is supplied by the control of the control circuit 100, the motor M starts to rotate the gear G.

The control circuit 100 controls the rotation of the motor M. The control circuit 100 rotates the roller 70 and the belt 603 using the motor M at a predetermined speed. It controls the motor so that the speed of the sheet P nipped and fed by the nip N in the fixing process operation is the same as a predetermined process speed (approx. 200 [mm/sec], for example).

[Heater]

Figure 4:
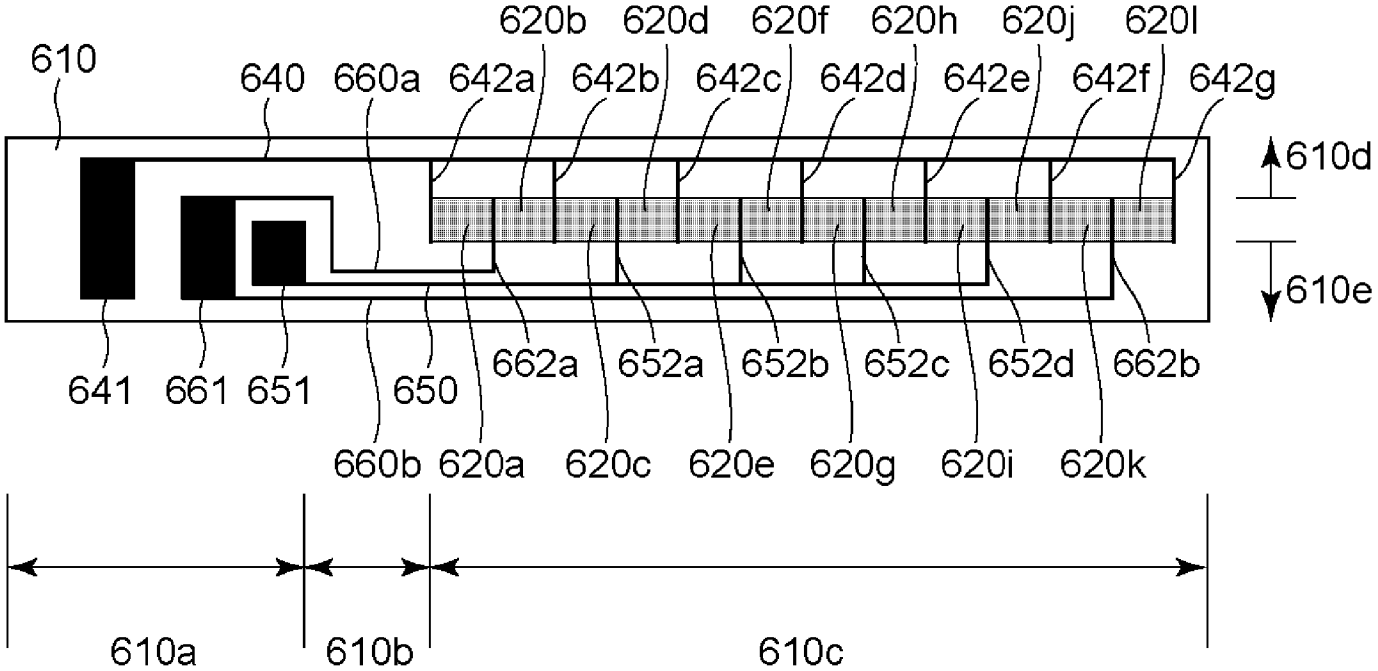
FIG. 4 illustrates a structure of a heater Embodiment 1.
Figure 6:
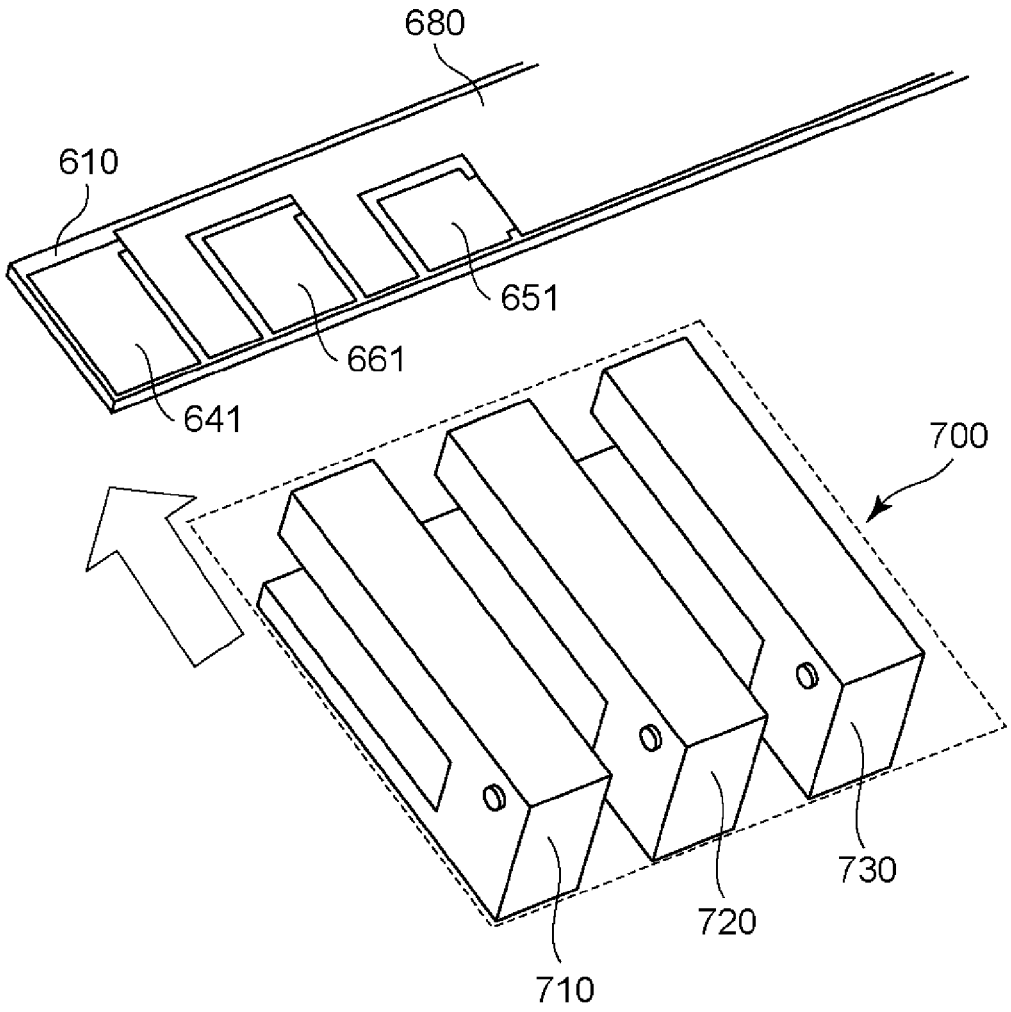
FIG. 6 illustrates a connector.
Figure 12:
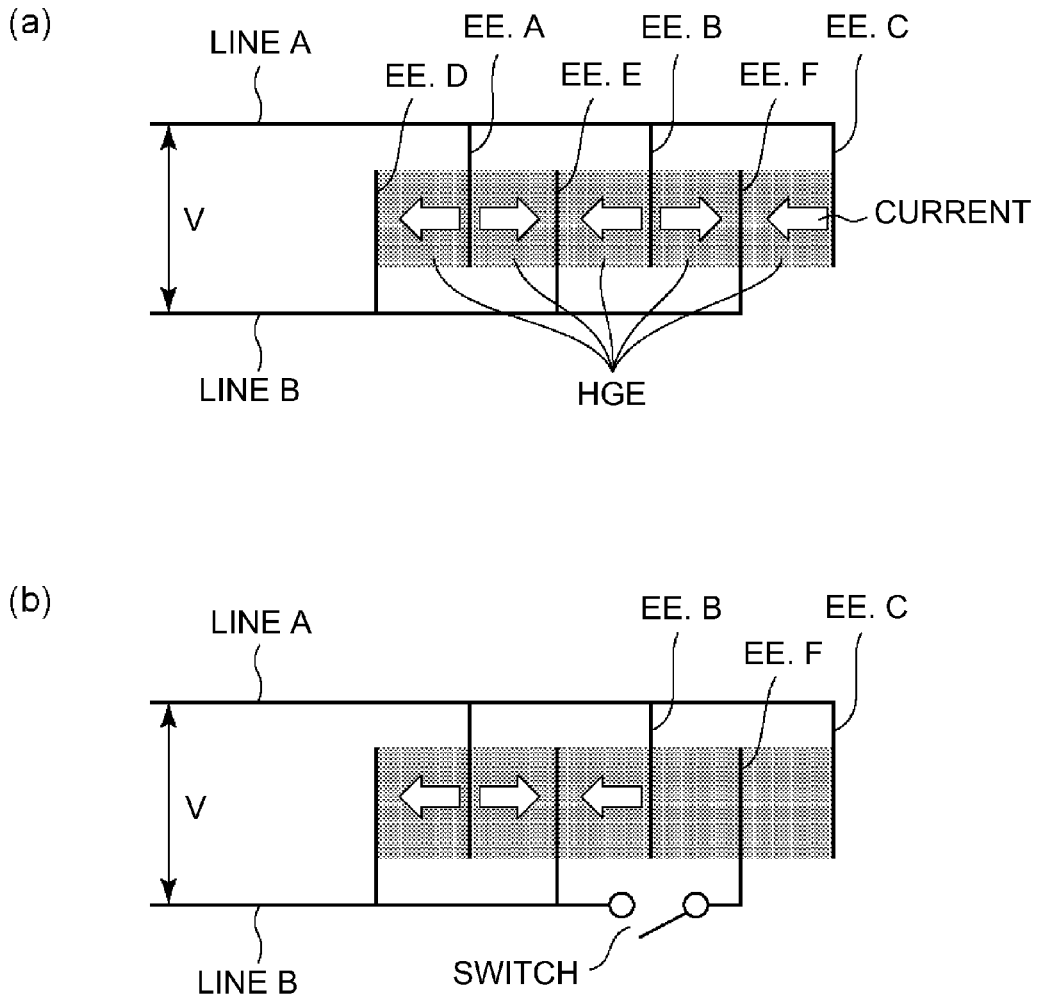
In FIG. 12, (a) illustrates a heat generating type of the heater, and (b) illustrates a switching system of a heat generating region of the heater.

The structure of the heater 600 used in the fixing device 40 will be described in detail. FIG. 4 illustrates a structure of the heater in Embodiment 1. FIG. 6 illustrates a contactor 700. In FIG. 12, (a) illustrates a heat generating type used in the heater 600, and (b) illustrates a heat generating region switching type used with the heater 600.

The heater 600 of this embodiment is a heater using the heat generating type shown in (a) and (b) of FIG. 12. As shown in (a) of FIG. 12, electrodes A-C are electrically connected with A-electroconductive-line ("LINE A"), and electrodes D-F are electrically connected with B-electroconductive-line ("LINE B"). The electrodes connected with the A-electroconductive-lines and the electrodes connected with the B-electroconductive-lines are interlaced (alternately arranged) along the longitudinal direction (left-right direction in (a) of FIG. 6), and heat generating elements are electrically connected between the adjacent electrodes. When a voltage V is applied between the A-electroconductive-line and the B-electroconductive-line, a potential difference is generated between the adjacent electrodes. As a result, electric currents flow through the heat generating elements, and the directions of the electric currents through the adjacent heat generating elements are opposite to each other. In this type heater, the heat is generated in the above-described the manner. As shown in (b) of FIG. 12, between the B-electroconductive-line and the electrode F, a switch or the like is provided, and when the switch is opened, the electrode B and the electrode C are at the same potential, and therefore, no electric current flows through the heat generating element therebetween. In this system, the heat generating elements arranged in the longitudinal direction are independently energized so that only a part of the heat generating elements can be energized by switching a part off. In other words, in the system, the heat generating region can be changed by providing switch or the like in the electroconductive line. In the heater 600, the heat generating region of the heat generating element 620 can be changed using the above-described system.

The heat generating element generates heat when energized, irrespective of the direction of the electric current, but it is preferable that the heat generating elements and the electrodes are arranged so that the currents flow along the longitudinal direction. Such an arrangement is advantageous over the arrangement in which the directions of the electric currents are in the widthwise direction perpendicular to the longitudinal direction (up-down direction in (a) of FIG. 12) in the following point. When joule heat generation is effected by the electric energization of the heat generating element, the heat generating element generates heat correspondingly to the resistance value thereof, and therefore, the dimension and the material of the heat generating element are selected in accordance with the direction of the electric current so that the resistance value is at a desired level. The dimension of the substrate on which the heat generating element is provided is very short in the widthwise direction as compared with that in the longitudinal direction. Therefore, if the electric current flows in the widthwise direction, it is difficult to provide the heat generating element with a desired resistance value, using a low resistance material. On the other hand, when the electric current flows in the longitudinal direction, it is relatively easy to provide the heat generating element with a desired resistance value, using the low resistance material. That is, in the case where the heat generating element is formed of the material having a low resistivity in the heater through which the current is flowed in the widthwise direction, there is a liability that the size of the heater with respect to the widthwise direction is increased. Specifically, in order to provide the heat generating element with a sufficient resistance by the low-resistivity material in the above-described heater, the heat generating element is required to be provided in a sufficiently long length with respect to the widthwise direction of the substrate. For that reason, a substrate having such a size that such a heat generating element can be disposed thereon is required, so that there is a liability that the widthwise size of the heater is increased. Further, in the case where the heat generating element is formed of a high-resistivity material in the above-described heater, there is a liability that a longitudinal temperature distribution of the heater becomes non-uniform. When the heat generating element is formed of the high-resistivity material, the heat generating element can be provided shortly with respect to the widthwise direction of the substrate. However, such a heat generating element is largely changed in resistance by a dimensional error thereof. In addition, when a high resistance material is used for the heat generating element, a temperature non-uniformity may result from non-uniformity in the thickness of the heat generating element when it is energized. For example, when the heat generating element material is applied on the substrate along the longitudinal direction by screen printing or like, a thickness non-uniformity of about 5% may result in the widthwise direction. This is because a heat generating element material painting non-uniformity occurs due to a small pressure difference in the widthwise direction by a painting blade. For that reason, a resistance distribution of the heat generating element becomes non-uniform, so that the heater generates a temperature non-uniformity with respect to the longitudinal direction thereof. Further, there was a liability that an image fixed using the heater generated uneven glossiness. Therefore, it was difficult to put the heater having the above-described constitution into practical use. For this reason, it is preferable that the heat generating elements and the electrodes are arranged so that the electric currents flow in the longitudinal direction.

In the case that the electric power is supplied individually to the heat generating elements arranged in the longitudinal direction, it is preferable that the electrodes and the heat generating elements are disposed such that the directions of the electric current flow alternates between adjacent ones. As to the arrangements of the heat generating members and the electrodes, it would be considered to arrange the heat generating elements each connected with the electrodes at the opposite ends thereof, in the longitudinal direction, and the electric power is supplied in the longitudinal direction. However, with such an arrangement, two electrodes are provided between adjacent heat generating elements, with the result of the likelihood of short circuit. In addition, the number of required electrodes is large with the result of large non-heat generating portion. Therefore, it is preferable to arrange the heat generating elements and the electrodes such that an electrode is made common between adjacent heat generating elements. With such an arrangement, the likelihood of the short circuit between the electrodes can be avoided, and the non-heat-generating portion can be made small.

In this embodiment, a common electroconductive line 640 corresponds to A-electroconductive-line of (a) of FIG. 12, and opposite electroconductive lines 650, 660*a*, 660*b* correspond to B-electroconductive-line. In addition, common electrodes 652*a*-652*g* correspond to electrodes A-C of (a) of FIG. 12, and opposite electrodes 652*a*-652*d*, 662*a*, 662*b* correspond to electrodes D-F. Heat generating elements 620*a*-620*l* correspond to the heat generating elements of (a) of FIG. 12. Hereinafter, the common electrodes 642*a*-642*g* are simply common electrode 642. The opposite electrodes 652*a*-652*e* are simply called opposite electrode 652. The opposite electrodes 662*a*, 662*b* are simply called opposite electrode 662. The opposite electroconductive lines 660*a*, 660*b* are simply called opposite electroconductive line 660. The heat generating elements 620*a*-620*l* are simply called heat generating element 620. The structure of the heater 600 will be described in detail referring to the accompanying drawings.

As shown in FIGS. 4 and 6, the heater 600 comprises the substrate 610, the heat generating element 620 on the substrate 610, an electroconductor pattern (electroconductive line), and an insulation coating layer 680 covering the heat generating element 620 and the electroconductor pattern.

The substrate 610 determines the dimensions and the configuration of the heater 600 and is contactable to the belt 603 along the longitudinal direction of the substrate 610. The material of the substrate 610 is a ceramic material such as alumina, aluminum nitride or the like, which has high heat resistivity, thermo-conductivity, electrical insulative property or the like. In this embodiment, the substrate is a plate member of alumina having a length (measured in the left-right direction in FIG. 4) of approx. 400 mm, a width (up-down direction in FIG. 4) of approx. 10 mm and a thickness of 1 mm.

On the back side of the substrate 610, the heat generating element 620 and the electroconductor pattern (electroconductive line) are provided through thick film printing method (screen printing method) using an electroconductive thick film paste. In this embodiment, a silver paste is used for the electroconductor pattern so that the resistivity is low, and a silver-palladium alloy paste is used for the heat generating element 620 so that the resistivity is high. As shown in FIG. 6, the heat generating element 620 and the electroconductor pattern coated with the coating layer 680 of heat resistive glass so that they are electrically protected from leakage and short circuit.

As shown in FIG. 4, there are provided electrical contacts 641, 651, 661 as a part of the electroconductor pattern in one end portion side of the substrate 610 with respect to the longitudinal direction. In addition, there are provided the heat generating element 620 common electrodes 642*a*-642*g* and opposite electrodes 652*a*-652*e*, 662*a*, 662*b* as a part of the electroconductor pattern in the other end portion side of the substrate 610 with respect to the longitudinal direction of the substrate 610. Between the one end portion side 610*a* of the substrate and the other end portion side 610*c*, there is a middle region 610*b*. In one end portion side 610*d* of substrate 610 beyond the heat generating element 620 with respect to the widthwise direction, the common electroconductive line 640 as a part of the electroconductor pattern is provided. In the other end portion side 610*e* of the substrate 610 beyond the heat generating element 620 with respect to the widthwise direction, the opposite electroconductive lines 650 and 660 are provided as a part of the electroconductor pattern.

The heat generating element 620 (620*a*-620*l*) is a resistor capable of generating joule heat by electric power supply (energization). The heat generating element 620 is one heat generating element member extending in the longitudinal direction on the substrate 610, and is disposed in the region 610*c* (FIG. 4) substantially in the neighborhood of the center portion of the substrate 610. The heat generating element 620 has a desired resistance value, and has a width (measured in the widthwise direction of the substrate 610) of 1-4 mm, a thickness of 5-20 μm. The heat generating element 620 in this embodiment has the width of approx. 2 mm and the thickness of approx. 10 μm. A total length of the heat generating element 620 in the longitudinal direction is approx. 320 mm, which is enough to cover a width of the A4 size sheet P (approx. 297 mm in width).

On the heat generating element 620, seven common electrodes 642*a*-642 *g* which will be described hereinafter are laminated with intervals in the longitudinal direction. In other words, the heat generating element 620 is isolated into six sections by common electrodes 642*a*-642 *g* along the longitudinal direction. The lengths measured in the longitudinal direction of the substrate 610 of each section are approx. 53.3 mm. On central portions of the respective sections of the heat generating element 620, one of the six opposite electrodes 652, 662 (652*a*-652*d*, 662*a*, 662*b*) are laminated. In this manner, the heat generating element 620 is divided into 12 sub-sections. The heat generating element 620 divided into 12 sub-sections can be deemed as a plurality of heat generating elements 620*a*-620*l*. In other words, the heat generating elements 620*a*-620*l* electrically connect adjacent electrodes with each other. Lengths of the sub-section measured in the longitudinal direction of the substrate 610 are approx. 26.7 mm. Resistance values of the sub-section of the heat generating element 620 with respect to the longitudinal direction are approx. 120Ω. With such a structure, the heat generating element 620 is capable of generating heat in a partial area or areas with respect to the longitudinal direction.

The resistivities of the heat generating elements 620 with respect to the longitudinal direction are uniform, and the heat generating elements 620*a*-620*l* have substantially the same dimensions. Therefore, the resistance values of the heat generating elements 620*a*-620*l* are substantially equal. When they are supplied with electric power in parallel, the heat generation distribution of the heat generating element 620 is uniform. However, it is not inevitable that the heat generating elements 620*a*-620*l* have substantially the same dimensions and/or substantially the same resistivities. For example, the resistance values of the heat generating elements 620*a* and 620*l* may be adjusted so as to prevent local temperature lowering at the longitudinal end portions of the heat generating element 620. At the positions of the heat generating element 620 where the common electrode 642 and the opposite electrode 652, 662 are provided, the heat generation of the heat generating element 620 is substantially zero. However, there is a heat uniformizing function of the substrate 610, and therefore the influence on the fixing process becomes a negligible level by suppressing the width (thickness) of the electrode to 1 mm or less. In this embodiment, the width of each electrode is 1 mm or less.

The common electrodes 642 (642*a*-642*g*) as a first electrode are a part of the above-described electroconductor pattern. The common electrode 642 extends in the widthwise direction of the substrate 610 perpendicular to the longitudinal direction of the heat generating element 620. In this embodiment, the common electrode 642 is laminated on the heat generating element 620. The common electrodes 642 are odd-numbered electrodes of the electrodes connected to the heat generating element 620, as counted from a one longitudinal end of the heat generating element 620. The common electrode 642 is connected to one contact 110*a* (one-side contact) of the voltage source 110 through the common electroconductive line 640 which will be described hereinafter.

The opposite electrodes 652, 662 as a second electrode are a part of the above-described electroconductor pattern. The opposite electrodes 652, 662 extend in the widthwise direction of the substrate 610 perpendicular to the longitudinal direction of the heat generating element 620. The opposite electrodes 652, 662 are the other electrodes of the electrodes connected with the heat generating element 620 other than the above-described common electrode 642. That is, in this embodiment, they are even-numbered electrodes as counted from the one longitudinal end of the heat generating element 620.

That is, the common electrode 642 and the opposite electrodes 662, 652 are alternately arranged along the longitudinal direction of the heat generating element. The opposite electrodes 652, 662 are connected to the other contact 110*b* (the other-side contact) of the voltage source 110 through the opposite electroconductive lines 650, 660 which will be described hereinafter.

The common electrode 642 and the opposite electrode 652, 662 function as electrode portions for supplying the electric power to the heat generating element 620. In this embodiment, the odd-numbered electrodes are common electrodes 642, and the even-numbered electrodes are opposite electrodes 652, 662, but the structure of the heater 600 is not limited to this example. For example, the even-numbered electrodes may be the common electrodes 642, and the odd-numbered electrodes may be the opposite electrodes 652, 662.

In addition, in this embodiment, four of the all opposite electrodes connected with the heat generating element 620 are the opposite electrode 652. In this embodiment, two of the all opposite electrodes connected with the heat generating element 620 are the opposite electrode 662. However, the allotment of the opposite electrodes is not limited to this example, but may be changed depending on the heat generation widths of the heater 600. For example, two may be the opposite electrode 652, and four may be the opposite electrode 662.

The common electroconductive line 640 is a part of the above-described electroconductor pattern. The common electroconductive line 640 extends along the longitudinal direction of the substrate 610 toward the one end portion side 610*a* of the substrate in the one end portion side 610*d* of the substrate. The common electroconductive line 640 is connected with the common electrodes 642 (642*a*-642*g*) which is in turn connected with the heat generating element 620 (620*a*-620*l*). The common electroconductive line 640 is connected to the electrical contact 641 which will be described hereinafter. In this embodiment, in order to assure the insulation of the coating layer 680, a gap of approx. 400 μm is provided between the common electroconductive line 640 and each opposite electrode.

The opposite electroconductive line 650 is a part of the above-described electroconductor pattern. The opposite electroconductive line 650 extends along the longitudinal direction of substrate 610 toward the one end portion side 610*a* of the substrate in the other end portion side 610*e* of the substrate. The opposite electroconductive line 650 is connected with the opposite electrodes 652 (652*a*-652*d*) which are in turn connected with heat generating elements 620 (620*c*-620*j*). The opposite electroconductive line 650 is connected to the electrical contact 651 which will be described hereinafter.

The opposite electroconductive line 660 (660*a*, 660*b*) is a part of the above-described electroconductor pattern. The opposite electroconductive line 660*a* extends along the longitudinal direction of substrate 610 toward the one end portion side 610*a* of the substrate in the other end portion side 610*e* of the substrate. The opposite electroconductive line 660*a* is connected with the opposite electrode 662*a* which is in turn connected with the heat generating element 620 (620*a*, 620*b*). The opposite electroconductive line 660*a* is connected to the electrical contact 661 which will be described hereinafter. The opposite electroconductive line 660*b* extends along the longitudinal direction of substrate 610 toward the one end portion side 610*a* of the substrate in the other end portion side 610*e* of the substrate. The opposite electroconductive line 660*b* is connected with the opposite electrode 662*b* which is in turn connected with the heat generating element 620. The opposite electroconductive line 660*b* is connected to the electrical contact 661 which will be described hereinafter. In this embodiment, in order to assure the insulation of the coating layer 680, a gap of approx. 400 μm is provided between the opposite electroconductive line 660*a* and the common electrode 642. In addition, between the opposite electroconductive lines 660*a* and 650 and between the opposite electroconductive lines 660*b* and 650, gaps of 100 μm are provided.

The electrical contacts 641, 651, 661 are a part of the above-described electroconductor pattern. Each of the electrical contacts 641, 651, 661 preferably has an area of not less than 2.5 mm×2.5 mm in order to assure the reception of the electric power supply from the connector 700 which will be described hereinafter. In this embodiment, the electrical contacts 641, 651, 661 has a length approx. 3 mm measured in the longitudinal direction of the substrate 610 and a width of not less than 2.5 mm measured in the widthwise direction of the substrate 610. The electrical contacts 641, 651, 661 are disposed in the one end portion side 610*a* of the substrate beyond the heat generating element 620 with gaps of approx. 4 mm in the longitudinal direction of the substrate 610. As shown in FIG. 6, no coating layer 680 is provided at the positions of the electrical contacts 641, 651, 661, so that the electrical contacts are exposed. The electrical contacts 641, 651, 661 are exposed on a region 610*a* which is projected beyond an edge of the belt 603 with respect to the longitudinal direction of the substrate 610. Therefore, the electrical contacts 641, 651, 661 are contactable to the connector 700 to establish electrical connection therewith.

When voltage is applied between the electrical contact 641 and the electrical contact 651 through the connection between the heater 600 and the connector 700, a potential difference is produced between the common electrode 642 (642*b*-642*f*) and the opposite electrode 652 (652*a*-652*d*). Therefore, through the heat generating elements 620*c*, 620*d*, 620*e*, 620*f*, 620*g*, 620*h*, 620*i*, 620*j*, the currents flow along the longitudinal direction of the substrate 610, the directions of the currents through the adjacent heat generating elements being substantially opposite to each other. The heat generating elements 620*c*, 620*d*, 620*e*, 620*f*, 620*g*, 620*h*, 620*i* as a first heat generating region generate heat, respectively.

When voltage is applied between the electrical contact 641 and the electrical contact 661*a* through the connection between the heater 600 and the connector 700, a potential difference is produced between the common electrode 642 and the opposite electrode 662*a* via the common electroconductive line 640 and the opposite electroconductive line 660*a*. Therefore, through the heat generating elements 620*a*, 620*b*, the currents flow along the longitudinal direction of the substrate 610, the directions of the currents through the adjacent heat generating elements being opposite to each other. The heat generating elements 620*a*, 620*b* as a second heat generating region adjacent the first heat generating region generate heat.

When voltage is applied between the electrical contact 641 and the electrical contact 661 through the connection between the heater 600 and the connector 700, a potential difference is produced between the common electrode 642 and the opposite electrode 662*b* through the common electroconductive line 640 and the opposite electroconductive line 660*b*. Therefore, through the heat generating elements 620*k*, 620*l*, the currents flow along the longitudinal direction of the substrate 610, the directions of the currents through the adjacent heat generating elements being opposite to each other. By this, the heat generating elements 620*k*, 620*l* as a third heat generating region adjacent to the first heat generating region generate heat.

In this manner, by selecting the electrical contacts supplied with the voltage, the desired one or ones of the heat generating elements 620*a*-620*l* to be intended to be heated can be selectively energized.

Between the one end portion side 610*a* of the substrate and the other end portion side 610*c*, there is a middle region 610*b*. More particularly, in this embodiment, the region between the common electrode 642*a* and the electrical contact 651 is the middle region 610*b*. The middle region 610*b* is a marginal area for permitting mounting of the connector 700 to the heater 600 placed inside the belt 603. In this embodiment, the middle region is approx. 26 mm. This is sufficiently larger than the distance required for insulating the common electrode 642*a* and the electrical contact from each other.

[Connector]

Figure 7:
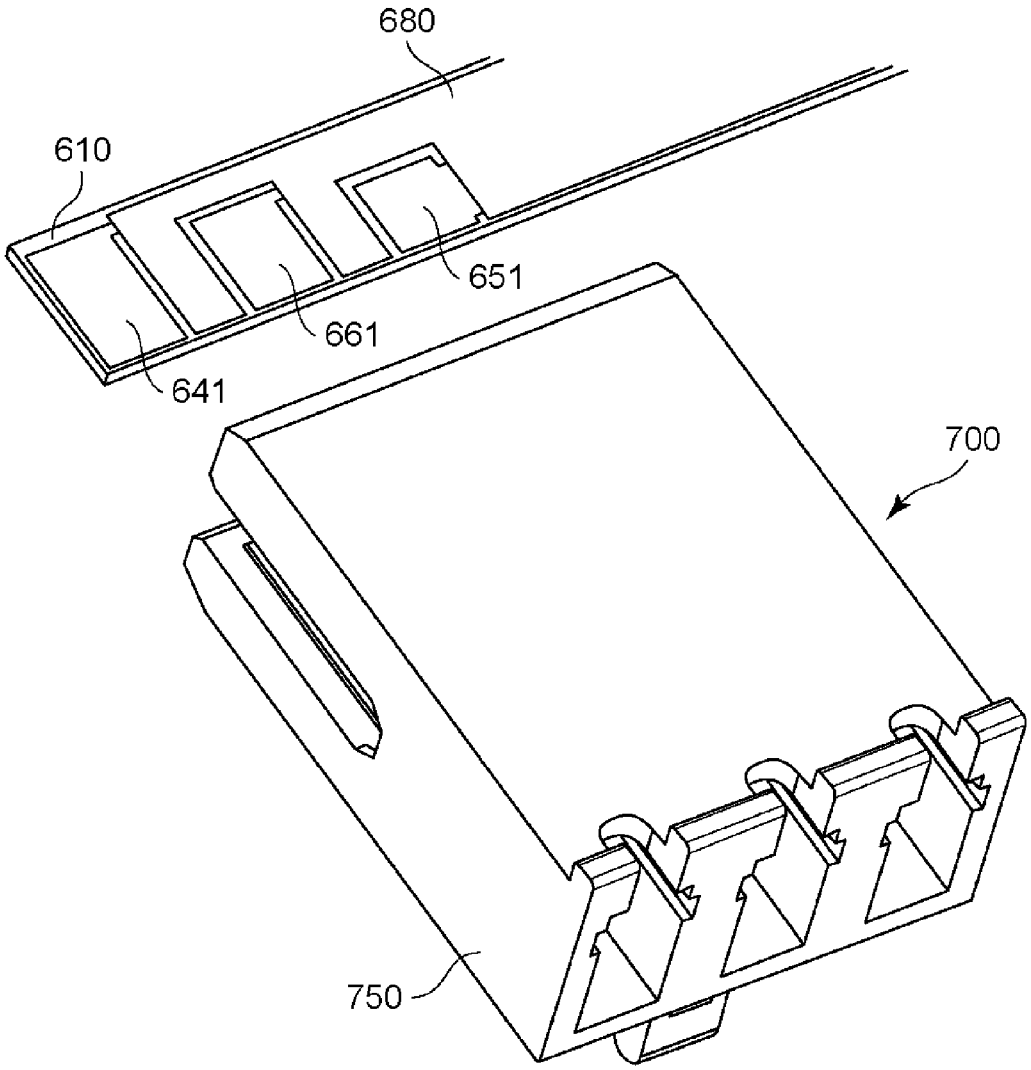
FIG. 7 illustrates a housing.
Figure 8:
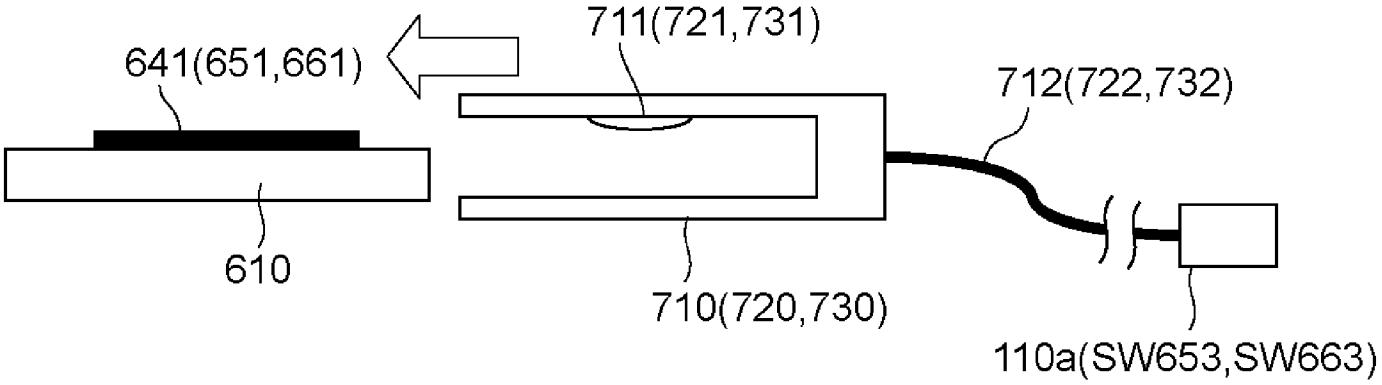
FIG. 8 illustrates a contact terminal.

The connector 700 used with the fixing device 40 will be described in detail. FIG. 7 illustrates a housing 750. FIG. 8 is an illustration of a contact terminal 710. The connector 700 of this embodiment is electrically connected with the heater 600 by mounting to the heater 600. The connector 700 comprises a contact terminal 710 electrically connectable with the electrical contact 641, and a contact terminal 730 electrically connectable with the electrical contact 651. The connector 700 also comprises a contact terminal 720 electrically connectable with the electrical contact 661. The connector 700 sandwiches a region of the heater 600 extending out of the belt 603 so as not to contact with the belt 603, by which the contact terminals an electrically connected with the electrical contacts, respectively. In the fixing device 40 of this embodiment having the above-described structures, no soldering or the like is used for the electrical connection between the connectors and the electrical contacts. Therefore, the electrical connection between the heater 600 and the connector 700 which rise in temperature during the fixing process operation can be accomplished and maintained with high reliability. In the fixing device 40 of this embodiment, the connector 700 is detachably mountable relative to the heater 600, and therefore, the belt 603 and/or the heater 600 can be replaced without difficulty. The structure of the connector 700 will be described in detail.

As shown in FIG. 6, the connector 700 provided with the metal contact terminals 710, 720, 730 is mounted to the heater 600 in the widthwise direction of the substrate 610 at one end portion side 610*a* of the substrate. The contact terminals 710, 720, 730 will be described, taking the contact terminal 710 for instance. As shown in FIG. 8, the contact terminal 710 functions to electrically connect the electrical contact 641 to a power source terminal 110*a* which will be described hereinafter. The contact terminal 710 is provided with a cable 712 for the electrical connection between the power source terminal 110*a* and the electrical contact 711 for contacting to the electrical contact 641. The contact terminal 710 has a channel-like configuration, and by moving in the direction indicated by an arrow in FIG. 8, it can receive the heater 600. The portion of the contact terminal 710 which contacts the electrical contact 641 is provided with the electrical contact 711 which contacts the electrical contact 641, by which the electrical connection is established between the electrical contact 641 and the contact terminal 710. The electrical contact 711 has a leaf spring property, and therefore, contacts the electrical contact 641 while pressing against it. Therefore, the contact 710 sandwiches the heater 600 between the front and backsides to fix the position of the heater 600.

Similarly, the contact terminal 720 functions to contact the electrical contact 661 with a switch SW663 which will be described hereinafter. The contact terminal 720 is provided with the electrical contact 721 (not shown) for connection to the electrical contact 661 and a cable 722 for connection to the switch SW663.

Similarly, the contact terminal 730 functions to contact the electrical contact 651 with a switch SW653 which will be described hereinafter. The contact terminal 730 is provided with the electrical contact 731 (not shown) for connection to the electrical contact 651 and a cable 732 for connection to the switch SW653.

As shown in FIG. 7, the contact terminals 710, 720, 730 of metal are integrally supported on the housing 750 of resin material. The contact terminals 710, 720, 730 are provided in the housing 750 with spaces between adjacent ones so as to be connectable with the electrical contacts 641, 661, 651, respectively when the connector 700 is mounted to the heater 600. Between adjacent contact terminals, partitions are provided to electrically insulate between the adjacent contact terminals.

In this embodiment, the connector 700 is mounted in the widthwise direction of the substrate 610, but this mounting method is not limiting to the present invention. For example, the structure may be such that the connector 700 is mounted in the longitudinal direction of the substrate.

[Electric Energy Supply to Heater]

An electric energy supply method to the heater 600 will be described. FIG. 9 is a list for illustrating states of the fixing device in Embodiment 1. The fixing device 40 of this embodiment is capable of changing a width of the heat generating region of the heater 600 by controlling the electric energy supply to the heater 600 in accordance with the width size of the sheet P. With such a structure, the heat can be efficiently supplied to the sheet P. In the fixing device 40 of this embodiment, the sheet P is fed with the center of the sheet P aligned with the center of the fixing device 40, and therefore, the heat generating region extend from the center portion. Further, in the fixing device in which the heat generation of the heater 600 is controlled by the control circuit 100, in the case where if the control circuit 100 is in a runaway state in which the control circuit 100 is uncontrollable, there is a liability that the heater 600 abnormally generates heat. For that reason, in this embodiment, the element 120 is provided so as to interrupt the electric energy supply to the heater during the abnormal heat generation of the heater 600. Further, the fixing device 40 is constituted so that even when the abnormal heat generation generates at any position of the heater 600 on which the plurality of heat generating elements 620*a*-620*l* are arranged in the longitudinal direction of the substrate 610, the abnormal heat generation can be detected by one (single) element 120. Specifically, by devising a circuit structure for supplying electric energy to the heater 600, the heat generating elements 620*a*-620*l* are caused to always generates heat during the electric energy supply to the heater 600. For that reason, by detecting the temperature of the heat generating elements 620*a*-62*l* which always generate heat, the element 120 can detect the abnormal heat generation of the heater 600 independently of the width size of the heat generating region of the heater 600. The electric energy supply to the heater 600 will be described in conjunction with the accompanying drawings.

The voltage source 110 as an electric energy (electric power) supplying portion is a circuit for supplying the electric power to the heater 600. In this embodiment, the commercial voltage source (AC voltage source) of approx. 100V in effective value (single phase AC) is used. The voltage source 110 of this embodiment is provided with a voltage source contact 110*a* and a voltage source contact 110*b* having different electric potential. The voltage source 110 may be DC voltage source if it has a function of supplying the electric power to the heater 600.

As shown in FIG. 5, the control circuit 100 is electrically connected with the, switch SW653 and the switch SW663, respectively, to control the switch SW653 and the switch SW663, respectively.

The switch SW653 is a switch provided between the power (voltage) source contact 110*b* and the electrical contact 651. The switch SW653 switches connects or disconnects between the power source contact 110*b* and the electrical contact 651 via the element 121 in accordance with the instructions from the control circuit 100. That is, the switch SW653 connects the power source contact 110*b* and the electrical contact 651 so that these contacts can be turned on and off. The switch SW663 is a switch provided between the switch SW 653 and the electrical contact 661. The switch SW663 switches connects or disconnects between the switch SW653 and the electrical contact 661 in accordance with the instructions from the control circuit 100. That is, the switch SW663 connects the switch SW653 and the electrical contact 661 so that these contacts can be turned on and off.

Here, the switches SW653, SW663 function as a connecting circuit 150 for electrically connecting the heater 600 and the power source 110 in order to supply, the electric energy to the heater 600. Further, the connecting circuit 150 is provided with the element 120.

The element 120 interrupts the electric energy supply to the heater when the heater 600 abnormally generates heat as described above. Specifically, the element 120 electrically connects between the switch SW653 and the power source contact 110*b*, and interrupts the connection during the detection of the abnormal heat generation of the heater 600. That is, in the case where the heater 600 abnormally generates heat, by the element 120, the electrical connection between the electric energy supplying circuit 150 and the heater 600 is interrupted.

When the control circuit 100 receives the execution instructions of a job, the control circuit 100 acquires the width size information of the sheet P to be subjected to the fixing process. In accordance with the width size information of the sheet P, a combination of ON/OFF of the switch SW653 and the switch SW663 is controlled so that the heat generation width of the heat generating element 620 fits the sheet P.

When the sheet P is a large size sheet (an example of a sheet having a width size broader than a predetermined width size), that is, when A3 size sheet P is fed in the longitudinal direction or when the A4 size sheet P is fed in the landscape fashion, the width of the sheet P is approx. 297 mm. Therefore, the control circuit 100 controls the electric power supply to provide the heat generation width B (FIG. 5) of the heat generating element 620. To effect this, the control circuit 100 renders ON all of the switch SW653 and the switch SW663. As a result, the heater 600 is supplied with the electric power through the electrical contacts 641, 661, 651, so that all of the 12 sub-sections of the heat generating element 620 generate heat. That is, the heat generating elements 620*a*-620*j* as the first heat generating element and the heat generating elements 620*a*, 620*b*, 620*k*, 620*l* as the second heat generating element generate heat. Incidentally, the heat generating elements 620*a*, 620*b* function as one end side heat generating element, and the heat generating elements 620*k*, 620*l* function as the other end side heat generating element. At this time, the heater 600 generates the heat uniformly over the approx. 320 mm region to meet the approx. 297 mm sheet P.

When the size of the sheet P is a small size (as an example of the sheet P having the predetermined width size), that is, when an A4 size sheet P is fed longitudinally, or when an A5 size sheet is fed in the landscape fashion, the width of the sheet P is approx. 210 mm. Therefore, the control circuit 100 provides a heat generation width A (FIG. 5) of the heat generating element 620. Therefore, the control circuit 100 renders ON the switch SW653 and renders OFF the switch SW663. As a result, the heater 600 is supplied with the electric power through the electrical contacts 641, 651, so that only 8 sub-sections of the 12 heat generating element 620 generate heat. That is, the heat generating elements 620*c*-620*j* as the first heat generating element generate heat. At this time, the heater 600 generates the heat uniformly over the approx. 213 mm region to meet the approx. 210 mm sheet P.

The electric energy supplying circuit 150 has such a nest structure that the switch SW663 is disposed downstream of the switch SW653 (in the heater 600 side). For that reason, even in a state in which the switch SW663 is turned on, unless the switch SW653 is turned on, the electric energy is not supplied from the electrical contact 661 to the heater 600. That is, the electric energy supplying circuit 150 is connected with the heat generating elements 620*c*-620*j*, so that electrical connection with the heat generating elements 620*a*, 620*b*, 620*k* and 620*l* is permitted. For that reason, in a state in which the heat generating elements 620*c*-620*j* do not generate heat, the heat generating elements 620*a*, 620*b*, 620*k*, 620*l* do not generate heat. In other words, in the case where the electric energy is supplied to the heater 600, the heat generating elements 620*c*-620*j* always generate heat irrespective of the width size of the sheet P.

With the constitution described above, the position of the element 120 relative to the heater with respect to the longitudinal direction is determined. That is, the element 120 is disposed so as to establish such a positional relationship that the element opposes any of the heat generating elements 620*c*-620*j* which always generate heat when the electric energy is supplied to the heater 600. Herein, such a relationship that two members oppose each other via another member is referred to as an opposing positional relationship. In this embodiment, the heater 600 and the element 120 oppose each other via the holder 601. The element 120 may desirably have the opposing positional relationship with a center-side-positioned one of the heat generating elements 620*c*-620*j* from the viewpoint of accuracy of temperature detection. In other words, the heat generating elements 620*c* and 620*j* which are liable to cause the temperature lowering by the influence of heat conduction through the substrate 610 are not preferred. The element 120 in this embodiment is disposed to establish the opposing positional relationship with the heat generating element 620*f*. When the heat generating element 620*f* generates heat, the heat is conducted to the element 120 via the substrate 610, the coat layer 680 and the holder 601. Then, the temperature of the heat generating element 620*f* reaches an abnormal heat generation temperature (a further predetermined temperature of, e.g., 260° C.-300° C.), and when the element 120 is heated up to an actuation temperature (e.g., about 260° C.), the element 120 interrupts (breaks) the connection between the power source terminal 110*b* and the switch SW653.

The above-described contents are summarized as follows. The number of possible states of the fixing device 40 is four. FIG. 9 is a list of the four states of the fixing device in Embodiment 1. In FIG. 9, in second and third columns, ON/OFF states of the switches SW653, SW663 are shown, and in fourth to sixth columns, an electric energy (electric power) supply state of the heat generating element 620 is shown. The electric energy supply state of the heat generating element 620 based on a combination of ON/OFF of the switches SW653, SW663 is shown as each of states 1-4. In FIG. 9, in the second and third columns, "o" represents ON state of the switches SW653, SW663, and "x" represents OFF state of the switches SW653, SW663. In the fourth to sixth columns, "o" represents that the electric energy is supplied to the heat generating element, and "x" represents that the electric energy is not supplied to the heat generating element. Further, the heat generating region (heat generation switch) A corresponds to the heat generating elements 620*c*-620*j*. A heat generating region b1 corresponds to the heat generating elements 620*a*, 620*b* as the first heat generating element. A heat generating region b2 corresponds to the heat generating elements 620*k*, 620*l* as the second heat generating element.

For example, in the state 1, the switch SW653 is in the ON state, and the heat generating region A generates heat. In the state 2, both of the switches SW653, SW663 are in the ON state, and all of the heat generating regions A, b1, b2 generate heat. That is, the heat generating element 620 generates heat in the range of the heat generation width B. In the state 3, the switch SW663 is in the ON state, and all of the heat generating regions do not generate heat. In the state 4, both of the switches SW653, SW663 are in the OFF state, and all of the heat generating regions do not generate heat.

Accordingly, in this embodiment, when any of the plurality of heat generating elements 620 generates heat, the heat generating element positioned in the heat generation width A always generates heat. For that reason, by monitoring the temperature in the heat generation width A, it is possible to detect the abnormal heat generation of the heater 600 with reliability.

As described above, in this embodiment, even when ON/OFF of the switches SW653, SW663 is uncontrollable, the abnormal heat generation can be detected by a small number of safety elements. Specifically, by disposing the element 120 so as to establish the opposing positional relationship with the heat generating elements 620*c*-620*j* positioned in the heat generation width A, even when the heater 600 abnormally generates heat by runaway of the control circuit 100, the electric energy supply to the heater 600 can be blocked with reliability.

In this embodiment, the number of corresponding heat generating patterns is two, but the fixing device 40 may also be constituted so as to meet three or more heat generating patterns. For example, the present invention is applicable to even a fixing device capable of meeting three or four heat generating patterns. That is, in the three or four heat generating patterns, a heat generating element which always generates heat during the supply of the electric energy is provided, and a temperature of this heat generating element is detected by the element 120, so that the electric energy supply to the heater 600 during the abnormal heat generation can be interrupted with reliability.

Conventional Example

Figure 13:
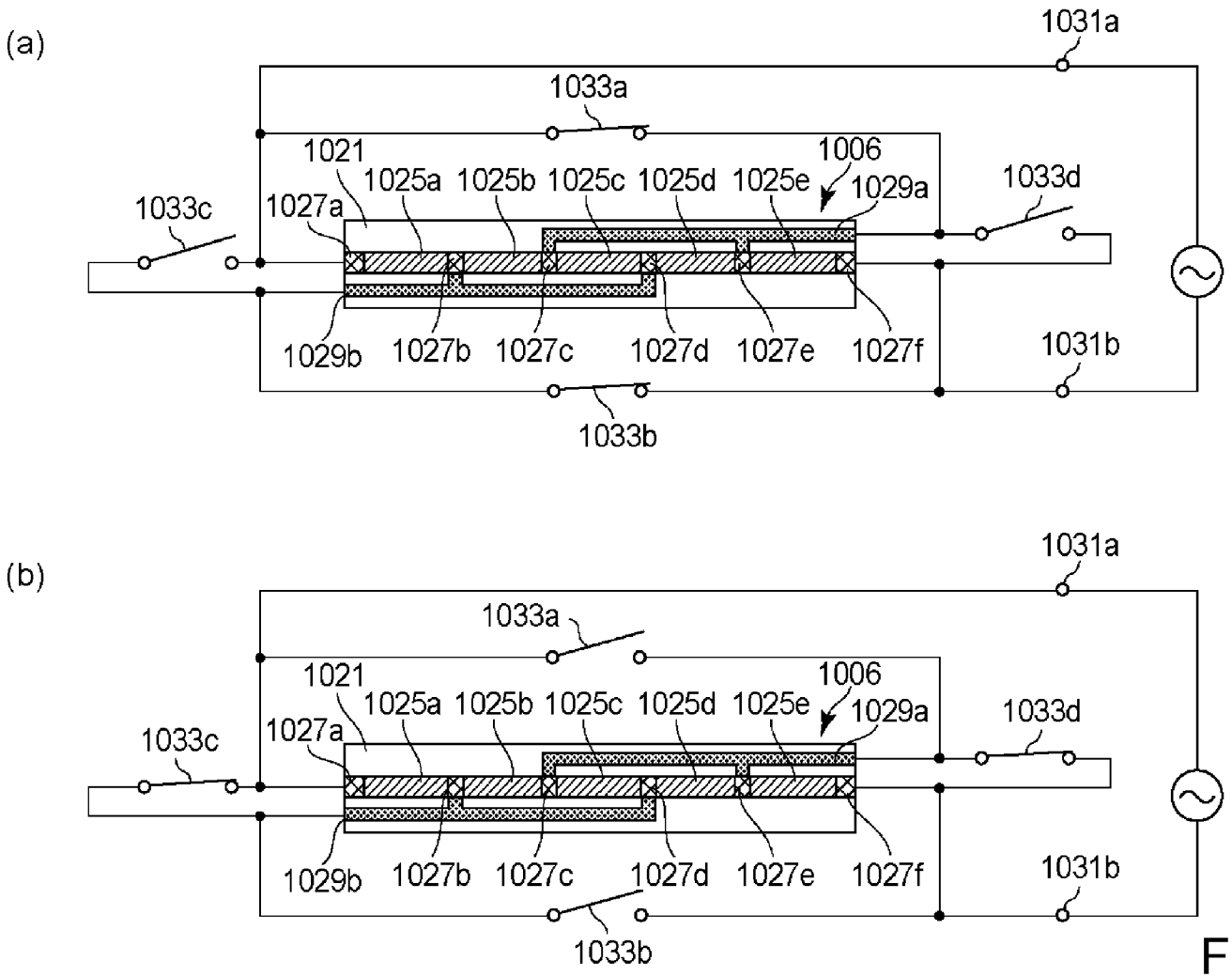
In FIG. 13, each of (a) and (b) is a circuit diagram of a conventional heater.

In order to verify an effect of the present invention, a comparison with Conventional Example (Japanese Laid-Open Patent Application 2012-37613) will be made. FIG. 10 is a list of states of a fixing device in Conventional Example. In FIG. 13, each of (a) and (b) is an illustration of a structure of the fixing device in Conventional Example.

A heater 1006 in a Conventional Example shown in FIG. 13 is similar to that in Embodiment 1 in that the current is caused to flow, along the longitudinal direction of the substrate, through a plurality of heat generating elements arranged in the longitudinal direction of the substrate. Further, the Conventional Example is similar to Embodiment 1 in that the number of heat generating elements to be caused to generate heat is changed depending on the width size of the sheet. A principal difference between Embodiment 1 and the Conventional Example is a method of supplying electric energy to the heat generating elements. In the electric energy supplying method in this embodiment (Embodiment 1), a relationship between with the electrodes and the power source contacts (terminal) connected with the electrodes is fixed, but in this embodiment, the relationship varies depending on switching of the switches. For that reason, in this embodiment, the switches SW653, SW663 can be disposed in a nest structure in the electric energy supplying circuit, but in the Conventional Example, it was difficult to dispose the switches in the nest structure. The heater 1006 in the Conventional Example will be described in detail with reference to the drawings.

First, the fixing device in the Conventional Example will be described. In the fixing device in the Conventional Example, a plurality of heat generating elements 1025*a*-1025*e* arranged in the longitudinal direction of a substrate 1021 are provided, and a heat generation width of the heater 1006 is changed depending on the width size of the sheet P. The change in heat generation width of the heater 1006 is made by combinations of ON/OFF of switches 1033*a*, 1033*b*, 1033*c*, 1033*d*. Hereinafter, sometimes these switches 1033*a*-1033*d* are collectively referred to as a switch 1033. For example, the sheet P having a large width size is heated, as shown in (a) of FIG. 13, the switches 1033*a*, 1033*b* are turned on, and the switches 1033*c*, 1033*d* are turned off. At this time, electrodes 1027*a*, 1027*c*, 1027*e* are connected with a power source contact (terminal) 1031*a*, and electrodes 1027*b*, 1027*d*, 1027*f* are connected with a power source contact (terminal) 1031*b*. For that reason, a potential difference generates between adjacent electrodes, so that the heat generating elements 1025*a*-1025*e* generate heat. Further, the sheet P having a small width size is heated, as shown in (b) of FIG. 13, the switches 1033*a*, 1033*b* are turned off, and the switches 1033*c*, 1033*d* are turned on. At this time, electrodes 1027*a*, 1027*b*, 1027*d* are connected with a power source contact 1031*a*, and electrodes 1027*c*, 1027*e*, 1027*f* are connected with a power source contact 1031*b*. For that reason, a potential difference generates between adjacent electrodes, so that the heat generating elements 1025*b*, 1025*c*, 1025*d* generate heat. In this way, in the Conventional Example, the power source contacts with which the electrodes are connected vary depending on the combination of ON/OFF of the switch 1003.

In such a fixing device, there is a liability that the switch 1033 becomes uncontrollable in the case where parts for the switch 1033 become defective due to aged deterioration or the like or in the case where the controller caused runaway, or in the like case.

The fixing device in the Conventional Example includes the four switches 1033 as shown in FIG. 13, and therefore the number of combinations of ON/OFF thereof is 16. Depending on the combinations of ON/OFF of the switches 1033, the electric energy is supplied to the heat generating elements 1025*a*-1025*e* as shown in FIG. 10. Hereinafter, sometimes the heat generating elements 1025*a*-1025*e* are collectively referred to as a heat generating element 1025. In FIG. 10, in the second to fifth columns, ON/OFF states of the switches 1033 are shown, and in the sixth to tenth columns, electric energy supply states of the heat generating elements 1025 are shown. The electric energy supply states of the heat generating elements 1025 depending on the combinations of the switches 1033 are shown as states 1-16. In FIG. 10, in the second to fifth columns "o" represents ON state of the switch 1033, and "x" represents OFF state of the switch 1033. In the sixth to tenth columns, "o" represents that the electric energy is supplied to the heat generating element, and "x" represents that the electric energy is not supplied to the heat generating element. Further, "short circuit" means a short-circuited state of the circuit, and shows that there is a liability of an occurrence of the short circuit.

The states 1-16 will be described.

The states 4, 13, 16 are a possible state of the fixing device when the controller and the switch 1033 normally operate. Specifically, the state 4 corresponds to a state of the heater 1006 when the sheet P having a large width size is heated. The state 13 corresponds to a state of the heater 1006 when the sheet P having a small width size is heated. The state 16 corresponds to a state of the fixing device in the case where the heat generation of the heater 1006 is at rest.

The states 1-3, 5-12, 14 and 15 are possible states of the fixing device only when the controller and the switch 1033 caused abnormality. Particularly, in the states 1-3, 5-7 and 9-11, the circuit causes the short circuit, so that the heater 1006 does not normally generate heat. In this regard, Embodiment 1 in which the circuit is constituted so as not to provide such combinations of ON/OFF of the switches 1033 is advantageous. Further, in the electric energy supplying method in the Conventional Example, due to its characteristic, it is difficult to constitute the circuit so that the switches 1033 have the nest structure. For that reason, in that respect, the electric energy supplying method in this embodiment in which the electric energy is supplied to the heat generating element 620 through the common electroconductive line 640 in one end side 610*d* of the substrate and through the opposite electroconductive lines 650, 660 in the other end side 610*e* of the substrate is advantageous.

On the other hand, in the states 4, 8, 12-15, the electric energy is normally supplied to at least one of the heat generating elements. However, these states are not useful for the fixing process because only the heat generating elements at the end portions generate heat. For that reason, this embodiment in which the electric energy supplying circuit 150 is constituted so as not to provide the combinations of ON/OFF of the switches 1033 is advantageous. If such combinations of ON/OFF of the switches 1033 are permitted, there are disadvantages as described below. For example, in the state 8, only the heat generating element 1025 generates heat alone. For that reason, a safety element adapted to the abnormal heat generation of the heat generating element 1025*e* is required. Similarly, in the case where the state 11 is taken into consideration, a safety element adapted to the abnormal heat generation of the heat generating element 1025*a* is required. Further, also the states 13 and 16 are considered, and therefore a safety element adapted to the abnormal heat generation of the heat generating element 1025*c* is required. Accordingly, in the fixing device in the Conventional Example, the safety element is required to be provided in at least three positions. Further, in the fixing device using such an electric energy supplying method, in the case where the fixing device is intended to be adapted to the sheets P having further more width sizes, the number of the heat generating elements 1025 and the switches 1033 is increased, and therefore further more safety elements are required to be disposed. For that reason, the constitution in this embodiment in which the abnormal heat generation of the heater 600 can be detected by the single safety element, irrespective of the number of the heat generating patterns is advantageous in terms of a space for permitting placement of the safety element and a costs of the safety element.

Embodiment 2

Figure 11:
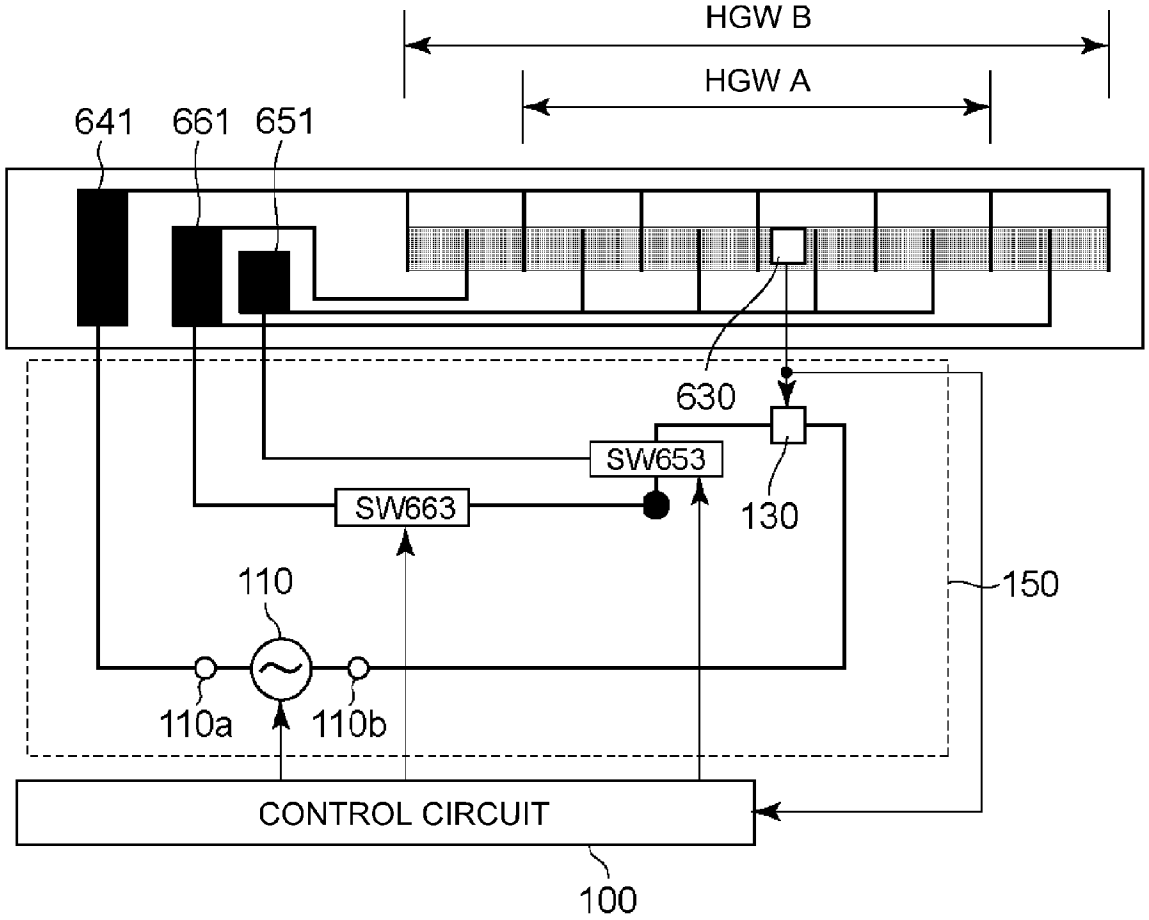
FIG. 11 illustrates a structural relationship of an image heating apparatus according to Embodiment 2.

Embodiment 2 will be described. FIG. 11 is a schematic view for illustrating a positional relationship among respective constituents for a fixing device 40 in this embodiment. In Embodiment 1, the electric energy supply to the heat generating element is interrupted during the abnormal heat generation of the heater 600 by providing the element 120 so that the element 120 opposes the heat generating elements which always generate heat when the electric energy is supplied to the heater 600. On the other hand, in this embodiment (Embodiment 2), as shown in FIG. 11, a voltage detecting relay 130 for switching ON/OFF of switches depending on an output voltage of the thermister 630 is provided on the electric energy supplying circuit 150. In this constitution, the thermister 630 and the relay 130 are connected with each other without via the control circuit 100, and therefore even when the control circuit is in a runaway state, it is possible to stop the electric energy supply to the heater by the electric energy supplying circuit 150. In the following, with reference to FIG. 11, the constitution of the fixing device 40 in this embodiment will be described in detail. The fixing device 40 in Embodiment 2 is constituted similarly as in Embodiment 1 except for the above-described difference. For that reason, the same reference numerals or symbols as in Embodiment 1 are assigned to the elements having the corresponding functions in this embodiment, and the detailed description thereof is omitted for simplicity.

The power source 110 is a circuit having the function of supplying the electric power (electric energy) to the heater 600. The switch SW653 is provided between the power source contact (terminal) 110*b* and the electrical contact 651. Depending on the instructions from the control circuit 100, the switch SW653 effects switching as to whether or not the power source contact 110*b* and the electrical contact 651 should be connected with each other via the relay 130. The switch SW663 is provided between the switch SW653 and the electrical contact 661. In this embodiment, the power source 110, the power source contacts 110*a*, 110*b* and the switches SW653, SW663 function as the electric energy supplying circuit 150 connected with the heater 600 so that the electric energy can be supplied to the heater 600. The electric energy supplying circuit 150 has the nest structure in which the switch SW663 is disposed downstream of the switch SW653 (in the heater 600 side).

The control circuit 100 is electrically connected with each of the switches SW653, SW663 in order to control each of the switches SW653, SW663. The control circuit 100 obtains width size information of the sheet P used for the fixing process on receipt of the instructions of execution of a job. Then, depending on the width size information of the sheet P, the control circuit 100 controls the combination of ON/OFF of the switches SW653, SW663 so that the heat generation width of the heat generating element 620 becomes a heat generation width suitable for the fixing process of the image on the sheet P.

With the above-described constitution, the position of the thermister 630 relative to the heater 600 with respect to the longitudinal direction is determined. That is, the thermister 630 is disposed so that the thermister 630 establishes the opposing positional relationship with any one or ones, of the heat generating elements 620*c*-620*j*, which always generate heat when the electric energy is supplied to the heater 600. In this embodiment, the heat generating element 620 and the thermister 630 oppose each other via the coat layer 680. The thermister 630 in this embodiment is disposed to establish the opposing positional relationship with the heat generating element 620*g*.

The thermister 630 as the temperature detecting element is connected with the relay, described hereinafter, without via the control circuit 100. For that reason, even if the control circuit 100 is in a runaway state, the relay 130 can be actuated. Specifically, the thermister 630 is a resistor having a PTC characteristic, and a resistance thereof becomes higher with an increasing temperature. To the thermister, a DV voltage of about 5 V is applied, so that the voltage is outputted as an output voltage through the resistance of the thermister 630. Specifically, to the control circuit 100, a signal is outputted via an A/D converter, and the voltage is directly outputted to the relay 130. The thermister 630 in this embodiment is adjusted so that the voltage of about 2.5 V is outputted at a temperature of about 200° C. That is, when the temperature of the thermister 630 is in the range from normal temperature (25° C.) to a fixing temperature (200° C.), an output of 5 V to 2.5 V is made. Then, when the temperature of thermister 630 becomes 260° C. or more (260° C.-300° C.), an output of less than 0.9 V, (i.e., an output of a predetermined signal) is made.

The voltage detecting relay 130 is an interrupting element for effecting ON/OFF of connection of the electric energy supplying circuit 150 on the basis of the output voltage of the thermister 630. As described above, the relay 130 interrupts the electric energy supply to the heater 600 when the heater 600 abnormally generated heat. Specifically, the relay 130 electrically connects between the switch SW653 and the power source contact 110*b*, and interrupts the connection when the abnormal heat generation of the heater 600 is detected. That is, in the case where the heater 600 caused the abnormal heat generation, the connection between the electric energy supplying circuit 150 and the heater 600 is interrupted by the element 120.

The relay 130 in this embodiment connects the electric energy supplying circuit when the output voltage of the thermister is 0.9 V-5 V. When the output voltage of the thermister 630 is less than 0.9 V, the relay 130 disconnects the electric energy supplying circuit.

That is, during the abnormal heat generation of the heater 600, the relay 130 operates in the following manner.

When the heat generating element 620*g* generates heat, the heat is conducted to the thermister via the coat layer 680. Then, the temperature of the heat generating element 620*g* reaches an abnormal heat generation temperature (e.g., 260° C.-300° C.), and when the thermister 630 is heated up to an actuation temperature (e.g., about 260° C.), the relay 130 interrupts the connection between the power source contact 110*b* and the switch SW653. For that reason, the electric energy supplied to the heater 600 is at rest, so that it is possible to terminate the heat generation of the heater 600.

As described above, in this embodiment, even when the ON/OFF of the switches SW653, SW663 is uncontrollable, it is possible to detect the abnormal heat generation of the heater 600 by a small number of thermistors 630. Specifically, by disposing the thermister 630 so as to establish the opposing positional relationship with the heat generating element 620 positioned in the heat generation width A, even when the heater 600 abnormally generates heat due to the runaway of the control circuit 100, it is possible to interrupt the electric energy supply to the heater 600 by the relay 130 with reliability.

In this embodiment, the number of corresponding heat generating patterns is two, but the fixing device 40 may also be constituted so as to meet three or more heat generating patterns. For example, the present invention is applicable to even a fixing device capable of meeting three or four heat generating patterns. That is, in the three or four heat generating patterns, a heat generating element which always generates heat during the supply of the electric energy is provided, and a temperature of this heat generating element is detected by the element 120, so that the electric energy supply to the heater 600 during the abnormal heat generation can be interrupted with reliability.

Other Embodiments

The present invention is not restricted to the specific dimensions in the foregoing embodiments. The dimensions may be changed properly by one skilled in the art depending on the situations. The embodiments may be modified in the concept of the present invention.

The heat generating region of the heater 600 is not limited to the above-described examples which are based on the sheets P are fed with the center thereof aligned with the center of the fixing device 40, but the sheets P may also be supplied on another sheet feeding basis of the fixing device 40. For example, the heat generating regions of the heater 600 may be modified so as to meet the case in which the sheets are supplied with one end thereof aligned with an end of the fixing device. More particularly, the heat generating elements corresponding to the heat generating region A are not heat generating elements 620*c*-620*j* but are heat generating elements 620*a*-620*e*. With such an arrangement, when the heat generating region is expanded from that for a small size sheet to that for a large size sheet, the heat generating region does not expand at both of the opposite end portions, but expands at one of the opposite end portions.

The number of patterns of the heat generating region of the heater 600 is not limited to two. For example, three or more patterns may be provided. Accordingly, in the electric energy supplying circuit 150, the switch connecting the nest structure with the switch SW653 is not limited to the switch SW663. A further switch connecting the nest structure with the switch SW653 may also be provided. The number and position of the electrical contacts are not limited to those described in Embodiments 1 and 2. For example, the substrate is extended to a side opposite from the side 610*a*, and some electrical contacts may also be provided at an extended portion. The number of the electrical contacts is not limited to three but may also be four or five or more.

The forming method of the heat generating element 620 is not limited to those disclosed in Embodiments 1, 2. In Embodiment 1, the common electrode 642 and in the opposite electrodes 652, 662 are laminated on the heat generating element 620 extending in the longitudinal direction of the substrate 610. However, the electrodes are formed in the form of an array extending in the longitudinal direction of the substrate 610, and the heat generating elements 620*a*-620*l* may be formed between the adjacent electrodes.

The belt 603 is not limited to that supported by the heater 600 at the inner surface thereof and driven by the roller 70. For example, so-called belt unit type in which the belt is extended around a plurality of rollers and is driven by one of the rollers. However, the structures of Embodiments 1 and 2 are preferable from the standpoint of low thermal capacity.

The member cooperative with the belt 603 to form of the nip N is not limited to the roller member such as a roller 70. For example, it may be a so-called pressing belt unit including a belt extended around a plurality of rollers.

The image forming apparatus which has been a printer 1 is not limited to that capable of forming a full-color, but it may be a monochromatic image forming apparatus. The image forming apparatus may be a copying machine, a facsimile machine, a multifunction machine having the function of them, or the like, for example, which are prepared by adding necessary device, equipment and casing structure.

The image heating apparatus is not limited to the apparatus for fixing a toner image on a sheet P. It may be a device for fixing a semi-fixed toner image into a completely fixed image, or a device for heating an already fixed image. Therefore, the fixing device 40 as the image heating apparatus may be a surface heating apparatus for adjusting a glossiness and/or surface property of the image, for example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-141765 filed on Jul. 9, 2014, which is hereby incorporated by reference herein in its entirety.

What is claimed is:

1. An image heating apparatus comprising:

an electrical energy supplying circuit provided with a first terminal and a second terminal; and a heater configured to generate heat for heating a toner image on a sheet, said heater comprising, an elongated substrate, a first electrical contact provided on said substrate and electrically connected to said first terminal, a second electrical contact provided on said substrate and electrically connected to said second terminal, said second electrical contact being electrically isolated from said first electrical contact, a third electrical contact provided on said substrate and electrically connected said second terminal, said third electrical contact being electrically isolated from said first electrical contact and said second electrical contact, a first common electroconductive line provided on said substrate and electrically connected with said first electrical contact, a second common electroconductive line provided on said substrate and electrically connected with said second electrical contact, a third common electroconductive line provided on said substrate and electrically connected with said third electrical contact, a first group of electrodes provided on said substrate and electrically connected with said first common electroconductive line;

a second group of electrodes provided on said substrate and arranged along a longitudinal direction of said substrate in an interlacing relationship with said electrodes of said first group, said second group of electrodes including (i) a first sub-group of electrodes electrically connected with said second common electroconductive line to form a first heating area, and (ii) a second sub-group of electrodes electrically connected with said third common electroconductive line to form a second heating area which includes the first heating area and which is wider than the first heating area in the direction together with said first sub-group of electrodes, a plurality of heat generating portions provided between adjacent ones of said electrodes so as to electrically connect between adjacent electrodes, said heat generating portions being capable of generating heat by electric power supplied between adjacent electrodes, and a thermal fuse provided on said substrate so as to overlap with the first heating area in the direction.

2. An image heating apparatus according to claim 1, wherein said first electrical contact, said second electrical contact and said third electrical contact are disposed at a position closer to one longitudinal end of said substrate than said heat generating portions in the direction.

3. An image heating apparatus according to claim 2, further comprising a connector detachably mountable to said heater, wherein said connector including (i) a first contact configured to connect between said electrical energy supplying circuit and said first electrical contact, (ii) a second contact configured to connect between said electrical energy supplying circuit and said second electrical contact and (iii) a third contact configured to connect between said electrical energy supplying circuit and said third electrical contact.

4. An image heating apparatus according to claim 1, wherein said electrical energy supplying circuit includes, an electrical source connected to said first electrical contact and to said thermal fuse;

a first switch connected to said second electrical contact and to said thermal fuse and configured to electrically turn on and off; and a second switch connected to said third electrical contact and to said thermal fuse and configured to electrically turn on and off.

5. An image heating apparatus according to claim 1, further comprising a holder configured to hold said heater, wherein said thermal fuse is disposed so as not to contact said holder.

6. An image heating apparatus according to claim 1, further comprising a holder configured to hold said heater, wherein said thermoswitch is disposed so as not to contact said holder.

7. An image heating apparatus comprising:

an electrical energy supplying circuit provided with a first terminal and a second terminal; and a heater configured to generate heat for heating a toner image on a sheet, said heater comprising, an elongated substrate, a first electrical contact provided on said substrate and electrically connected to said first terminal, a second electrical contact provided on said substrate and electrically connected to said second terminal, said second electrical contact being electrically isolated from said first electrical contact, a third electrical contact provided on said substrate and electrically connected to said second terminal, said third electrical contact being electrically isolated from said first electrical contact and said second electrical contact, a first common electroconductive line provided on said substrate and electrically connected with said first electrical contact, a second common electroconductive line provided on said substrate and electrically connected with said second electrical contact, a third common electroconductive line provided on said substrate and electrically connected with said third electrical contact, a first group of electrodes provided on said substrate and electrically connected with said first common electroconductive line, a second group of electrodes provided on said substrate and arranged along a longitudinal direction of said substrate in an interlacing relationship with said electrodes of said first group, said second group of electrodes including (i) a first sub-group of electrodes electrically connected with said second common electroconductive line to form a first heating area, and (ii) a second sub-group of electrodes electrically connected with said third common electroconductive line to form a second heating area which includes the first heating area and which is wider than the first heating area in the direction together with said first sub-group of electrodes, a plurality of heat generating portions provided between adjacent ones of said electrodes so as to electrically connect between adjacent electrodes, said heat generating portions being capable of generating heat by electric power supplied between adjacent electrodes, and a thermoswitch provided on said substrate so as to overlap with the first heating area in the direction.

8. An image heating apparatus according to claim 7, wherein said first electrical contact, said second electrical contact and said third electrical contact are disposed at a position closer to one longitudinal end of said substrate than said heat generating portions in the direction.

9. An image heating apparatus according to claim 8, further comprising a connector detachably mountable to said heater, wherein said connector including (i) a first contact configured to connect between said electrical energy supplying circuit and said first electrical contact, (ii) a second contact configured to connect between said electrical energy supplying circuit and said second electrical contact and (iii) a third contact configured to connect between said electrical energy supplying circuit and said third electrical contact.

10. An image heating apparatus according to claim 7, wherein said electrical energy supplying circuit includes, an electrical source connected to said first electrical contact and to said thermoswitch;

a first switch connected to said second electrical contact and to said thermoswitch and configured to electrically turn on and off; and a second switch connected to said third electrical contact and to said thermoswitch and configured to electrically turn on and off.

11. A heater comprising:

an elongated substrate;

a first electrical contact provided on said substrate;

a second electrical contact provided on said substrate and electrically isolated from said first electrical contact;

a third electrical contact provided on said substrate end electrically isolated from said first electrical contact and said second electrical contact;

a first common electroconductive line provided on said substrate and electrically connected with said first electrical contact;

a second common electroconductive line provided on said substrate and electrically connected with said second electrical contact;

a third common electroconductive line provided on said substrate and electrically connected with said third electrical contact;

a first group of electrodes provided on said substrate and electrically connected with said first common electroconductive line;

a second group of electrodes provided on said substrate and arranged along a longitudinal direction of said substrate in an interlacing relationship with said electrodes of said first group, said second group of electrodes including (i) a first sub-group of electrodes electrically connected with said second common electroconductive line to form a first heating area, and (ii) a second sub-group of electrodes electrically connected with said third common electroconductive line to form a second heating area which includes the first heating area and which is wider than the first heating area in the direction together with said first sub-group of electrodes;

a plurality of heat generating portions provided between adjacent ones of said electrodes so as to electrically connect between adjacent electrodes, said heat generating portions being capable of generating heat by an electrical power supply between adjacent electrodes; and a thermal fuse provided on said substrate so as to overlap with the first heating area in the direction.

12. A heater according to claim 11, wherein said first electrical contact, said second electrical contact and said third electrical contact are disposed at a position closer to one longitudinal end of said substrate than said heat generating portions in the direction.

13. A heater comprising:

an elongate substrate;

a first electrical contact provided on said substrate;

a second electrical contact provided on said substrate and electrically isolated from said first electrical contact;

a third electrical contact provided on said substrate end electrically isolated from said first electrical contact and said second electrical contact;

a first common electroconductive line provided on said substrate and electrically connected with said first electrical contact;

a second common electroconductive line provided on said substrate and electrically connected with said second electrical contact;

a third common electroconductive line provided on said substrate and electrically connected with said third electrical contact;

a first group of electrodes provided on said substrate and electrically connected with said first common electroconductive line;

a second group of electrodes provided on said substrate and arranged along a longitudinal direction of said substrate in an interlacing relationship with said electrodes of said first group, said second group of electrodes including (i) a first sub-group of electrodes electrically connected with said second common electroconductive line to form a first heating area, and (ii) a second sub-group of electrodes electrically connected with said third common electroconductive line to form a second heating area which includes the first heating area and which is wider than the first heating area in the direction together with said first sub-group of electrodes;

a plurality of heat generating portions provided between adjacent ones of said electrodes so as to electrically connect between adjacent electrodes, said heat generating portions being capable of generating heat by an electrical power supply between adjacent electrodes; and a thermoswitch provided on said substrate so as to overlap with the first heating area in the direction.

14. A heater according to claim 13, wherein said first electrical contact, said second electrical contact and said third electrical contact are disposed at a position closer to one longitudinal end of said substrate than said heat generating portions in the direction.

15. A heater comprising:

an elongate substrate;

a first electrical contact provided on said substrate;

a second electrical contact provided on said substrate and electrically isolated from said first electrical contact;

a third electrical contact provided on said substrate end electrically isolated from said first electrical contact and said second electrical contact;

a first common electroconductive line provided on said substrate and electrically connected with said first electrical contact;

a second common electroconductive line provided on said substrate and electrically connected with said second electrical contact;

a third common electroconductive line provided on said substrate and electrically connected with said third electrical contact;

a first group of electrodes provided on said substrate and electrically connected with said first common electroconductive line;

a second group of electrodes provided on said substrate and arranged along a longitudinal direction of said substrate in an interlacing relationship with said electrodes of said first group, said second group of electrodes including (i) a first sub-group of electrodes electrically connected with said second common electroconductive line to form a first heating area, and (ii) a second sub-group of electrodes electrically connected with said third common electroconductive line to form a second heating area which includes the first heating area and which is wider than the first heating area in the direction together with said first sub-group of electrodes;

a plurality of heat generating portions provided between adjacent ones of said electrodes so as to electrically connect between adjacent electrodes, said heat generating portions being capable of generating heat by an electrical power supply between adjacent electrodes; and a thermal element provided on said substrate so as to overlap with the first heating area in the direction and configured to shut down the electrical energy supply to said heat generating portions by breakage or deformation with a temperature rise thereof.

* * * * *